US005673906A

United States Patent [19]

Furuya et al.

[11] Patent Number: 5,673,906

[45] Date of Patent: Oct. 7, 1997

[54] SHEET POST-TREATING APPARATUS

[75] Inventors: Kimihiko Furuya; Misao Kobayashi; Hideki Mimura; Takehiko Saitou, all of Yamanasi-ken; Masahiro Kouno, Yamanashi-ken, all of Japan

[73] Assignee: Nisca Corporation, Yamanashi-ken, Japan

[21] Appl. No.: 423,154

[22] Filed: Apr. 17, 1995

[30] Foreign Application Priority Data

Apr. 15, 1994 [JP] Japan ..... 6-101965

[51] Int. Cl.[6] ..... B65H 39/02

[52] U.S. Cl. ..... 270/58.14; 270/58.15; 270/58.16; 270/58.17; 270/58.28

[58] Field of Search ..... 271/213, 294; 355/324, 323; 270/58.01, 58.07, 58.08, 58.11, 58.12, 58.13, 58.14, 58.15, 58.16, 58.17, 58.28

[56] References Cited

U.S. PATENT DOCUMENTS

| | | | |
|---|---|---|---|
| 3,802,694 | 4/1974 | Post et al. | 271/294 X |
| 3,995,748 | 12/1976 | Looney | 271/294 X |
| 4,145,037 | 3/1979 | Mol | 271/294 X |
| 4,376,529 | 3/1983 | George et al. | 270/53 |
| 4,479,641 | 10/1984 | Bean et al. | 270/58.11 |
| 4,549,804 | 10/1985 | Braun et al. | 270/53 X |
| 4,552,497 | 11/1985 | Kockler et al. | 270/58.08 X |
| 4,605,211 | 8/1986 | Sonobe | 270/58.17 |
| 4,925,171 | 5/1990 | Kramer et al. | 270/53 |
| 4,946,154 | 8/1990 | Nakamura | 270/58.08 |
| 5,040,782 | 8/1991 | Benedict | 271/294 |
| 5,186,445 | 2/1993 | Nakanishi et al. | 270/53 |
| 5,320,336 | 6/1994 | Asami | 270/53 X |
| 5,398,918 | 3/1995 | Rizzolo et al. | 270/58.08 X |

FOREIGN PATENT DOCUMENTS

| | | | |
|---|---|---|---|
| 63-66060 | 3/1988 | Japan | 271/213 |
| 2-56354 | 2/1990 | Japan | 271/213 |
| 2-56355 | 2/1990 | Japan | 271/213 |
| 4-49162 | 2/1992 | Japan | 271/213 |

*Primary Examiner*—Hoang Nguyen

*Attorney, Agent, or Firm*—Kane, Dalsimer, Sullivan, Kurucz, Levy, Eisele, and Richard, LLP

[57] ABSTRACT

A sheet post-treating apparatus has a horizontally disposed sorting tray to receive sheets. The sheets are discharged from the horizontally disposed sorting tray into a discharge tray. At least portions of the discharge tray can be moved vertically to accommodate varying height stacks of sheets.

19 Claims, 18 Drawing Sheets

SHEET POST-TREATING APPARATUS

BACKGROUND OF THE INVENTION AND RELATED STATEMENT

The present invention relates to a sheet post-treating apparatus for treating the sheets which are transferred from an image forming apparatus, more specifically, it relates to a sheet post-treating apparatus in which the sheets transferred from the image forming apparatus are sorted or grouped to the respective sorting trays and then discharged to a discharge tray while a stapling treatment is executed.

In a conventional copying machine or printer, there is a requirement to discharge plural sets of plural pages of copied or printed sheets therefrom. To satisfy this requirement, generally, a sorter is attached to the copying machine or printer. That is to say, by connecting the sorter to the copying machine or printer, the copied or printed sheets are collected onto the respective sorting trays every set in a sorting mode or every page in a grouping mode. As a result, an operator can easily take out the copied or printed sheets from the sorting trays while he or she can distinguish the sheets of each set in the sorting mode or each page in the grouping mode.

Without the post-treating apparatus the sheets must be separately placed on a table stacked by sets or by pages or stacked on the table in a jogged manner to be manually stapled. These post-treatments to the sheets are very troublesome and time-consuming to the operator, especially in a case where there are a large amount of sets or pages.

Conventionally, a sheet post-treating apparatus which was disclosed in U.S. Pat. No. 5,384,634 has been proposed, as shown in FIG. 1. A reference character A in FIG. 1 indicates each of the sorting trays onto which copied or printed sheets P transferred from the copying machine or printer are successively stacked. Each of the sorting trays A is arranged in the sheet post-treating apparatus and inclined to the side surface of a frame D of the sheet post-treating apparatus.

As shown in FIG. 1, a pair of aligning rods B and C for aligning the sheets P in a predetermined position are arranged on both sides of the sorting tray A, respectively. A pair of stapler mechanisms E and F are attached to a portion of the frame D which faces to the rear portion of the sheets P stacked on the sorting tray A. An urging member H for urging the sheets P on the sorting trays A in a discharge direction Y to discharge them to a discharge tray G is arranged on a rear side of the sorting trays A.

The discharge tray G is movable in a discharge direction Y in which the copied or printed sheets P are discharged from the sorting tray A and which is perpendicular to a take-in direction in which the copied or printed sheets P are transferred from the copying machine or printer. The discharge tray G is to be parallel to each of the inclined sorting trays A. That is, the discharge tray G is inclined to the horizontal plane and attached to the front surface of the frame D in such a manner that it meets at right angles to the front surface of the frame D.

In the conventional sheet post-treating apparatus as shown in FIG. 1, a pile of the sheets P stacked on the sorting tray A is collectively discharged therefrom to the discharge tray G in the discharge direction Y by the urging member H while one lateral side of the pile of sheets P is stapled at at least one point by the stapler mechanism E and/or F on the way, when a stapling mode is selected.

On the other hand, in the conventional sheet post-treating apparatus, a first pile of the sheets P stacked on the sorting tray A is collectively discharged therefrom to the discharge tray G which is positioned to a first jogging position and a second pile of the sheets P stacked on a next sorting tray A is then collectively discharged therefrom to the discharge tray which is moved to a second jogging position in the discharge direction X, when a jogging mode is selected. Accordingly, the alternate piles of sheets P discharged on the discharge tray G are jogged in the discharge direction Y.

Where the staple mode is selected in the conventional sheet post-treating apparatus, the pile of sheets P is discharged along a flat plane, which is inclined to the horizontal plane, by being pushed by the urging member H in the discharge direction Y.

Accordingly, at first, it is necessary that each of the sorting trays A has a length in the discharge direction Y which length is equal to or longer than that of the sheet P, in the discharge direction Y, because the whole pile of sheets P must be placed on the sorting tray A. If a part of the pile of sheets P is dropped out of the sorting tray A, the outer shape of the pile of the sheets P is bent. As a result, if the pile of the sheets P is stapled by the pair of stapler mechanisms E and F, the bent shape of the pile of the sheets P is fixed.

Furthermore, it is necessary that the discharge tray G has a length in the discharge direction Y which length is equal to or longer than that of the sheet P in the discharge direction Y. This requires a large extension of the discharge tray G at the front side, thereby causing the total size of the sheet post-treating apparatus be excessively large.

SUMMARY OF THE INVENTION

The present invention, therefore, has as its principal object to provide a sheet post-treating apparatus which is reduced in size relative to the conventional apparatus.

Another important object of the present invention is to provide a sheet post-treating apparatus which can maintain the posture of the pile of sheets fed to the discharge tray.

In order to attain the above-mentioned objects, there is provided a sheet post-treating apparatus according to a first aspect of the present invention which comprises: a frame; a plurality of sorting trays to which sheets are successively supplied from an image forming apparatus and on which said sheets are collected and stacked, each of said sorting trays being movable in a vertical direction and one of said sorting trays, which is moved to a treatment position where the sheets are to be discharged therefrom, being set to be substantially horizontal; discharge means for collectively discharging a pile of the sheets stacked on the horizontal sorting tray in a discharge direction which intersects to a supply direction in which the sheets are supplied from the image forming apparatus onto the sorting tray; and a discharge tray to which the pile of the sheets are discharged by the discharge means.

According to a second aspect of the present invention, there is provided a sheet post-treating apparatus which comprises: a frame; a plurality of sorting trays to which sheets are successively supplied from an image forming apparatus and on which said sheets are collected and stacked, each of said sorting trays being movable in a vertical direction and one of said sorting trays which is moved to a treatment position where the sheets are to be discharged therefrom being set to be substantially horizontal; discharge means for collectively discharging a pile of the sheets stacked on the horizontal sorting tray in a discharge direction; and a discharge tray to which the pile of the sheets are discharged by the discharge means and which is vertically moveable, at least partially.

BRIEF DESCRIPTION OF THE DRAWINGS

These and other objects of the subject invention will become more fully apparent as the following description is read in light of the attached drawings wherein.

DETAILED DESCRIPTION OF PREFERRED EMBODIMENT

Hereinafter, the detailed description of preferred embodiment of a sheet post-treating apparatus according to the present invention will be given with reference to the accompanying drawings of FIGS. 2 through 22.

[Description of entire construction of sheet post-treating apparatus]

Figure 1:
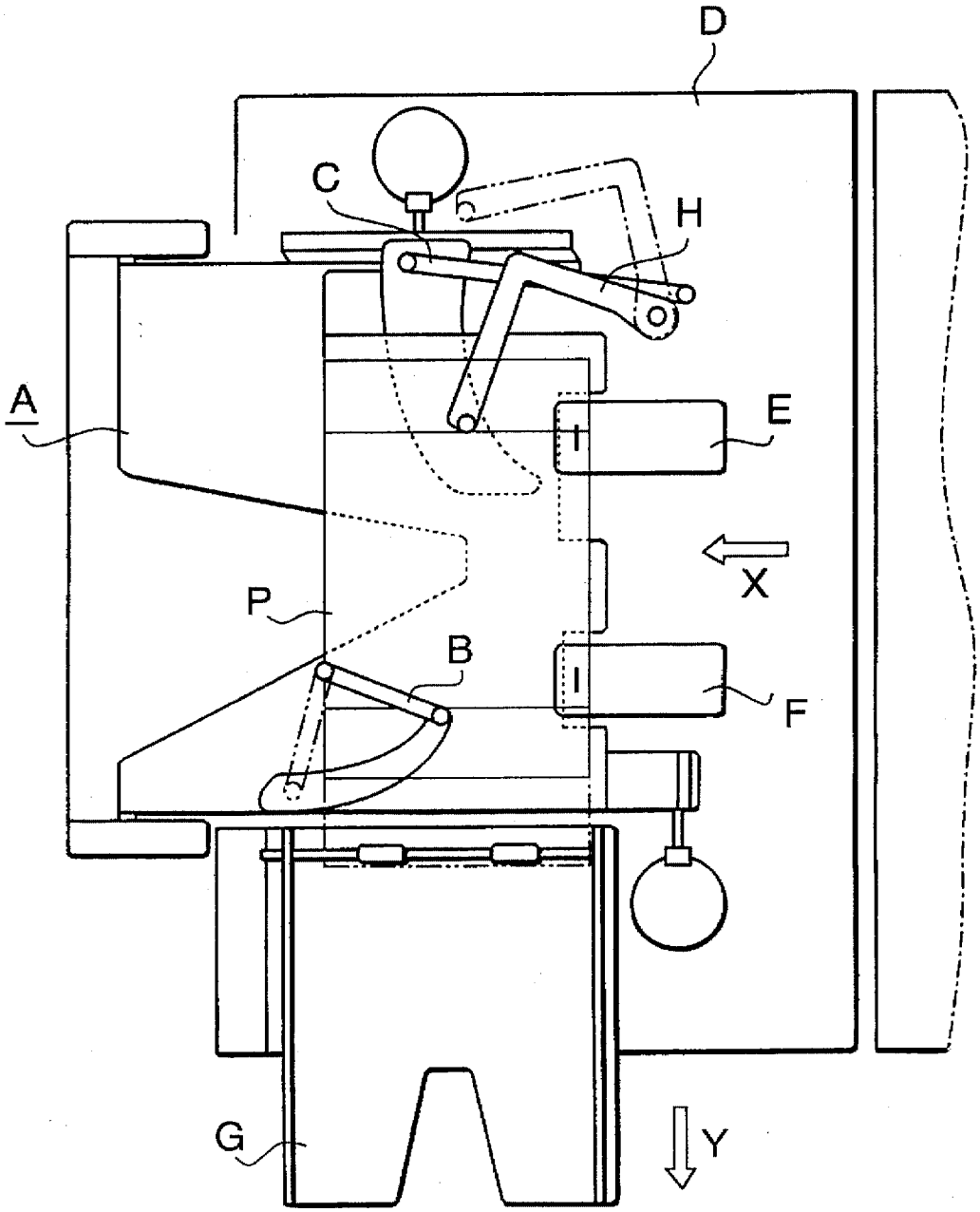
FIG. 1 (PRIOR ART)
FIG. 1 is a plan view schematically showing the construction of conventional sheet post-treating apparatus.
Figure 2:
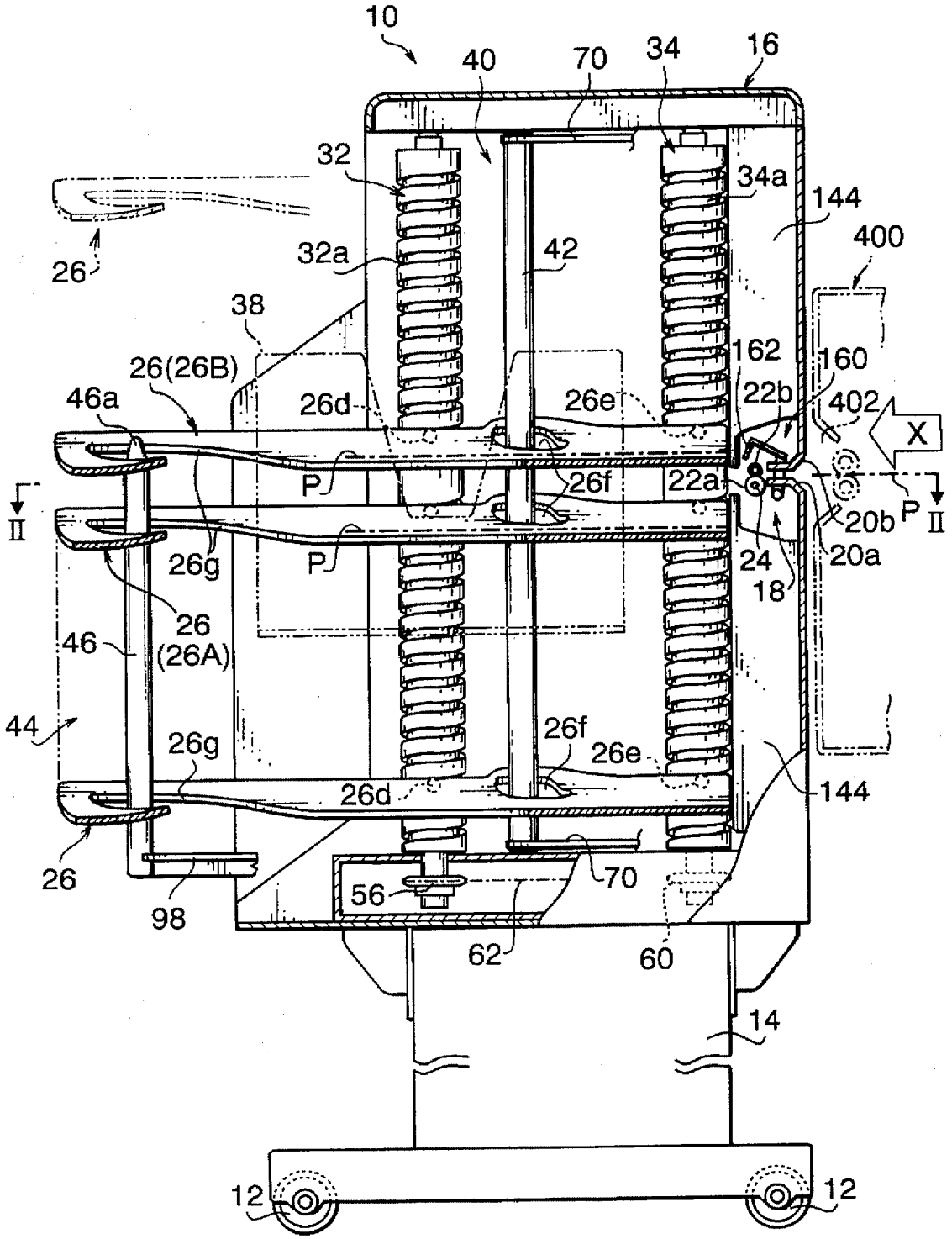
FIG. 2 is a front elevational sectional view showing a construction of preferred embodiment showing a sheet post-treating apparatus according to the present invention and taken along the line I—I in FIG. 3.

At first, the schematic description of the entire construction of the sheet post-treating apparatus 10 will be given with reference to the FIGS. 2 to 4. As shown in FIG. 2, the sheet post-treating apparatus 10 is to be connected mechanically and electrically to a sheet processor such as an image forming apparatus, i.e. electrostatic copying machine 400 in the present embodiment, and constructed so as to execute a so-called "sorting treatment", a so-called "grouping treatment", a so-called "jogging treatment", a so-called "stapling treatment", and so on, independently or combinations thereof to a plurality of copied sheets transferred from the electrostatic copying machine 400.

In the present embodiment, the sorting treatment means that, in the case where plural pages of originals are copied, each set includes all of the pages copied.

The grouping treatment means that, in the case where plural pages of originals are copied to sheets by plural sets in the electrostatic copying machine 10, each set includes a plurality of copies of the same page.

The jogging treatment means that the copied sheets stacked on the sorting trays are discharged to and stacked on a common discharge tray in such a manner that alternate stacks are indented in the stacking direction.

The stapling treatment means that the staple mechanism staples the sheets which are being discharged from the sorting trays. The stapling treatment is not usually executed where the jogging treatment has already been executed.

As shown in FIG. 2, the sheet post-treating apparatus 10 is provided with a base 14 which is movable on a floor through casters 12 attached to the undersurface of the base 14, and a frame 16 fixed onto the base 14.

[Description of take-in mechanism 18]

A take-in mechanism 18 is arranged to the frame 16 so as to face to an exit port 402 of the copying machine 400 and provided for receiving the copied sheets P which are transferred from the exit port 402 and forwarding them inside the frame 16 in a take-in direction X as shown in FIG. 2. The take-in mechanism 18 generally includes a pair of lower and upper guide plates 20*a* and 20*b* through which copied sheet P transferred from the exit port 402 is to be inserted, and a pair of lower and upper take-in rollers 22*a* and 22*b* which are adjacent to the exit of the guide plates 20*a* and 20*b* and between which the copied sheet P is clamped.

The lower take-in roller 22*a* is coaxially fixed to a drive shaft 24 which is driven to be rotated by a transfer motor 158 which will be described later. The upper take-in roller 22*b* is biased by an urging member (not shown) and pressingly, rolling-contacted to the lower take-in roller 22*a*.

Thus, the copied sheet P transferred through the exit port 402 from the electrostatic copying machine 400 is guided by the lower and upper guide plates 20*a* and 20*b* and clamped by the lower and upper take-in rollers 22*a* and 22*b*, and then taken inside the frame 16 in the take-in direction X upon the rotation of the lower take-in roller 22*a*.

[Description of sorting tray 26]

A plurality of sorting trays 26 are arranged inside the frame 16 in the vertical direction. The sorting trays 26 are driven to be moved vertically by a tray drive mechanism 28 as described later. In other words, the vertical position of each of the sorting trays 26 is capable of changing and the vertical gap between the adjacent sorting trays 26 is capable of adjusting through the tray drive mechanism 28.

Each of the sorting trays 26 is set to be parallel to the floor (that is, horizontal). Each sorting tray 26 includes a tray body 26*a* on which the copied sheets P are stacked, a slant portion 26*b* integrally connected to the rear side of the tray body 26*a* (that is, to a portion of the tray body 26*a* which portion is positioned on the upstream side of the tray body 26*a* with respect to a discharge direction Y) and slanted upwardly as it extends rearward. Note that the discharge direction Y is defined as a horizontal direction perpendicular to the take-in direction X, directed to the front side, as shown in FIG. 3.

Although details will be given later, the copied sheets P taken in by the take-in mechanism 18 are stacked on at least one of the sorting trays 26, in an aligned condition with reference to its front side edge (that is, an edge of the copied sheet P which edge is positioned on the downstream side with respect to the take-in direction X) and its left side edge (that is, an edge of the copied sheet P which edge is positioned on the downstream side with respect to the discharge direction Y).

From the sorting tray 18 which opposes to the take-in mechanism 18 and on which the copied sheets P transferred from the copying machine 400 are directly received, the copied sheets P stacked thereon are collectively taken out in the discharge direction Y by a take-out mechanism 136, which will be described later in detail, and discharged in the discharge direction Y by a discharge mechanism 36 which will also be described later in detail. Finally, the copied sheets P thus discharged by the discharge mechanism 136 are forwarded onto a discharge tray 38.

For the sake of clear description, hereinafter, the sorting tray 26 which opposes to the take-in mechanism 18 and on which the copied sheets P transferred from the copying machine 400 are stacked is expressed as "the sorting tray in a treatment position" and assigned a special reference numeral "26A". Also, the sorting tray 26 which is positioned just above the sorting tray 26A in the treatment position is assigned reference numeral "26B".

On the right hand of the front side edge of each sorting tray 26, a first engaging piece 26*c* for engaging with a screw groove 30*a* of a first screw rod 30 is integrally attached thereto. On both the left and right hands of the rear side edge of each sorting tray 26, second and third engaging pieces 26*d* and 26*e* for engaging with screw grooves 32*a* and 34*a* of second and third screw rods 32 and 34, respectively, are integrally attached thereto. The first to third screw rods 30, 32 and 34 constitute a tray drive mechanism 28 which will be mentioned later.

Figure 3:
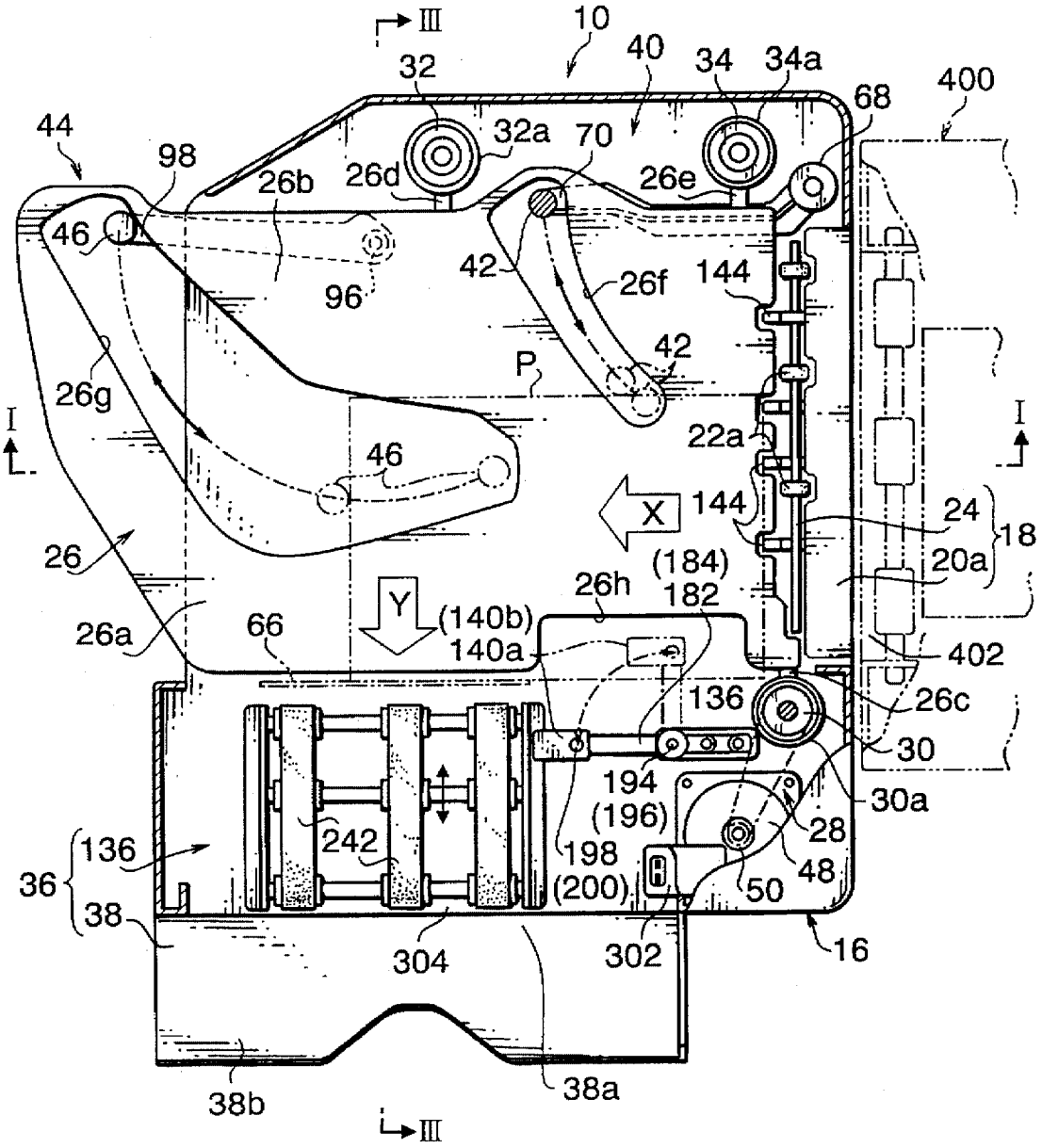
FIG. 3 is a plan sectional view showing the sheet post-treating apparatus taken along the line II—II in FIG. 2.

As shown in FIG. 3, each sorting tray 28 is formed with a first opening 26*f* which has a predetermined shape for not interfering with the movement of a lateral aligning rod 42 of a lateral alignment mechanism 40 which will be described later in detail, and a second opening 26*g* which has a predetermined shape for not interfering with a longitudinal aligning rod 46 of a longitudinal alignment mechanism 44 which will be described later in detail.

[Description of tray drive mechanism 28]

As shown in FIG. 3, the tray drive mechanism 28 generally includes the first screw rod 30 arranged on the front side in the frame 16 and on the upstream side with respect to the take-in direction X, the second screw rod 32 arranged on the rear side in the frame 16 and on the downstream side with respect to the take-in direction X and the third screw rod 34 arranged on the rear side in the frame 16 and on the upstream side with respect to the take-in direction X. Each of the first through third screw rods 30, 32 and 34 is set to stand upright and be rotatable about the vertical central axis thereof.

The first through third engaging pieces 26*c*, 26*d* and 26*e* of each sorting tray 26 are engaged with the first through third screw grooves 30*a*, 32*a* and 34*a*, respectively. Each sorting tray 26 with the first through third engaging pieces 26*c*, 26*d* and 26*e* is moved upward or downward upon the rotation of the first through third screw rods 30, 32 and 34 which are rotated by a tray drive motor 48, and a desired sorting tray 26 is selectively moved to the treatment position.

Each of first through third screw grooves 30*a*, 32*a* and 34*a* is formed in such a manner that the sorting tray 26 with the first through third engaging pieces 26*c*, 26*d* and 26*e* rises or falls down by one pitch upon every one rotation of the first through third screw rods 30, 32 and 34. As shown in FIG. 4, a vertical distance between the sorting tray 26A in the treatment position and the sorting tray 26B just above the sorting tray 26A is set to be longer than that between the other adjacent two sorting trays 26. Accordingly, a multiple of copied sheets P can be stacked on the sorting tray 26A in the treatment position.

Figure 8:
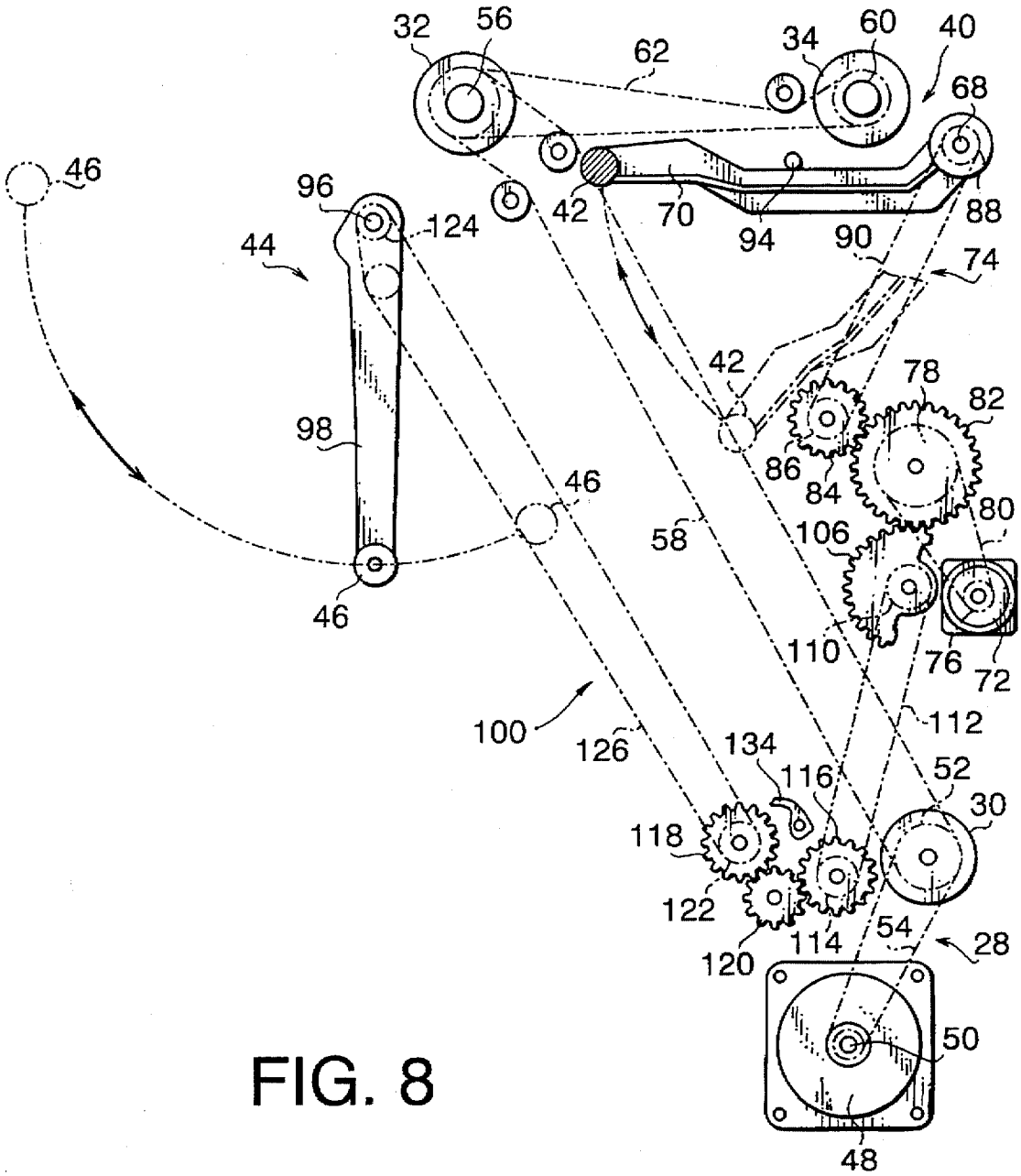
FIG. 8 is a plan view showing a tray driving mechanism and first and second driving force transmitting mechanism of the sheet post-treating apparatus.

As shown in FIG. 8, the tray drive mechanism 28 generally includes the tray drive motor 48, a driving sprocket 50 which is integrally attached to the motor shaft of the tray drive motor 48, a first driven sprocket 52 which is integrally attached to the lower end of the first screw rod 30, an endless first driving force transmitting chain 54 is wound between the driving sprocket 50 and the first driven sprocket 52, a second driven sprocket 56 which is integrally attached to the lower end of the second screw rod 32, an endless second driving force transmitting chain 58 which is wound between the first driven sprocket 52 and the second driven sprocket 56, a third driven sprocket 60 which is integrally attached to the third screw rod 34, and an endless third driving force transmitting chain 62 which is wound between the second driven sprocket 56 and the third driven sprocket 60.

As a result, the sorting tray 26 is driven to move upward upon the rotation of the tray drive motor 48 in one direction, while to move downward upon the rotation of the tray drive motor 48 in the other direction.

[Description of lateral alignment mechanism 40]

The description will be given about the lateral alignment mechanism 40 for pushing the copied sheets P taken in on the sorting tray 26A by the take-in mechanism 18 in the discharge direction Y (that is, in the lateral direction of the copied sheet P) to cause the copied sheets P to abut against a discharge shutter plate 66 of a discharge shutter mechanism 64 which will be described later in detail, and for aligning the copied sheets P received on the sorting tray 26A, standardizing the left side edge thereof with respect to the take-in direction X (that is, the edge of the copied sheets P on the downstream side with respect to the discharge direction Y).

As shown in FIGS. 2 and 3, the lateral alignment mechanism 40 generally includes the lateral aligning rod 42 which is arranged on the upstream side with respect to the discharge direction Y in the frame 16 and extends vertically to pass through the first opening 26*f*, a pair of upper and lower first swing arms 70 which are connected to the upper and lower portions of the lateral aligning rod 42, respectively, at the distal ends thereof, and an upright first support shaft 68 (shown in FIG. 8) to which proximal ends of the upper and lower first swing arms 70 are fixed at the upper and lower portions thereof, respectively, and rotatable about the vertical axis thereof.

As shown in FIG. 8, the lateral alignment mechanism 40 further includes a reversible alignment motor 72, and a first driving force transmitting mechanism 74 for transmitting the driving force of the alignment motor 72 to the first support shaft 68 thereby driving to swing the lateral aligning rod 42 upon the rotation of the first support shaft 68.

As shown in FIG. 3, the shape of the first opening 26*f* is formed to include at least an arcuate locus with a radius corresponding to the length of the first swing arm 70 and a center as the first support shaft 68, and formed not to interfere the swinging movement of the lateral aligning rod 42.

Figure 19:
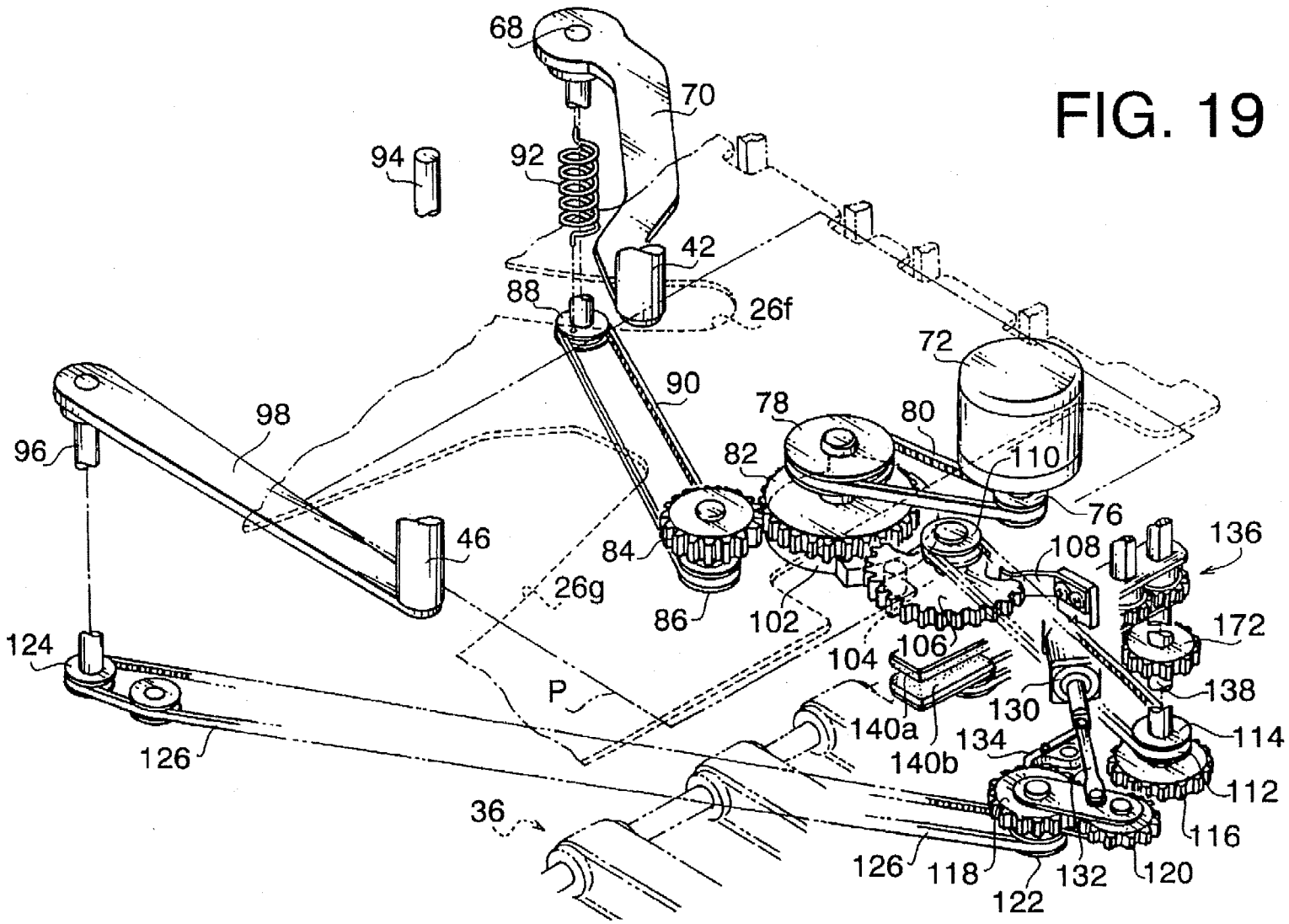
FIG. 19 is a perspective view schematically showing a driving force transmitting system for a lateral aligning rod, longitudinal aligning rod, and the gripping pieces.

As shown in FIGS. 8 and 19, the first driving force transmitting mechanism 74 generally includes a driving sprocket 76 coaxially fixed to the motor shaft of the alignment motor 72, a first idle sprocket 78 (shown in FIG. 19), an endless first driving force transmitting chain 80 wound between the driving sprocket 76 and the first idle sprocket 78, a first transmitting gear 82 coaxially fixed to the first idle gear 78, a second transmitting gear 84 meshed with the first transmitting gear 82, a second sprocket 86 coaxially fixed to the second transmitting gear 84, a first driven sprocket 88 coaxially fixed to the first support shaft 68, and an endless second driving force transmitting chain 90 wound between the second idle sprocket 86 and the first driven sprocket 88.

As shown in FIG. 19, the first driven sprocket 88 and the first swing arm 70 are coupled to each other through a coil spring 92 which is loosely wound around the first support shaft 68, one end of which is connected to the first driven sprocket 88 and the other end of which is connected to the first swinging arm 70. The first swinging arm 70 is biased to rotate clockwise in the drawing, toward an home position (shown by a solid line in FIG. 8) by the coil spring 92. Accordingly, the lateral aligning rod 42 is elastically held in its home position by abutting stopper 94 under the urging force of the coil spring 92.

Since the first driving force transmitting mechanism 74 is constructed as described above in detail, the first driven sprocket 88 is driven to rotate counterclockwise in the drawing upon the clockwise rotation of the alignment motor 72. The lateral aligning rod 42 is swung counterclockwise from the home position against the urging force of the coil spring 92, to push the copied sheets P on the sorting trays 26 in the discharge direction Y to the lateral aligning position (shown by a one-dot-and-dashed line in FIGS. 3 and 8). As a result, the copied sheets P are forcibly abutted against the discharge shutter plate 66 and its lateral position aligned, that is, the position in the discharge direction Y.

On the other hand, the lateral aligning rod 42 is swung clockwise from the aligning position upon the counterclockwise rotation of the alignment motor 72, and returned to the home position by abutting the first swing arm 70 to the stopper 94. Note that the situation where the aligning motor 72 further rotates clockwise while the first swing arm 70 has already been abutting to the stopper 94 would occur. Even though such situation would occur, the coil spring 92 is only further wound in a tightening direction and the lateral aligning rod 42 is stably held in the home position.

As mentioned above, the slant portion 26*b* of the sorting tray 26 is inclined upward to the tray body 26*a* as it extends rearward. As a result, the copied sheets P are moved in the discharge direction Y by being pushed by the lateral aligning rod 42 which is swung from the home position to the lateral aligning position, without any bending thereof.

[Description of longitudinal alignment mechanism 44]

The description will be given about the longitudinal alignment mechanism 44 for pushing the copied sheets P stacked on the sorting tray 26 in the take-in direction X (that is, in the longitudinal direction of the copied sheet P) to cause the copied sheets P to clamp between the longitudinal aligning rod 46 and a rear restriction plates 144, which will be described later, and for aligning the copied sheets P received on the sorting tray 26A, standardizing the front side edge thereof with respect to the take-in direction X (that is, the edge of the copied sheet P on the downstream side with respect to the take-in direction X).

As shown in FIGS. 2 and 3, the longitudinal alignment mechanism 44 generally includes the longitudinal aligning rod 46 which is arranged on the downstream side with respect to the take-in direction X in the frame 16, extends vertically to pass through the second opening 26*g* and is movable between a home position and a longitudinal aligning position in the take-in direction X based on an information related to the sheet size from the copying machine 400, a second swing arm 98 which is connected to the lower portion of the longitudinal aligning rod 46 at the distal end thereof, and an upright second support shaft 96 (shown in FIG. 8) to which proximal end of the second swing arm 98 is fixed at the upper portion thereof and rotatable about the vertical axis thereof.

As shown in FIGS. 8 and 19, the longitudinal alignment mechanism 44 further includes a second driving force transmitting mechanism 100 for transmitting the driving force of the alignment motor 72 to the second support shaft 96 to swing the second swing arm 98 about the second support shaft 96.

As shown in FIG. 3, the shape of the second opening 26*g* is formed to include at least an arcuate locus with a radius corresponding to the length of the second swing arm 96 and a center as the second support shaft 96, and formed not to interfere the swinging movement of the longitudinal aligning rod 46.

As shown in FIG. 19, the second driving force transmitting mechanism 100 generally includes a cam member 102 coaxially fixed to the first transmitting gear 82, a sector gear 106 to which a cam follower 104 to be engaged with the cam member 102 is integrally attached and which is capable of engaging with the first transmitting gear 106, an urging member 108 for urging the sector gear 106 so as to mesh with the first transmitting gear 82, a third idle sprocket 110 fixed to the sector gear 106, a fourth idle sprocket 114, a third driving force transmitting chain 112 wound between the third and fourth idle sprockets 110 and 114, and a third transmitting gear 116 coaxially fixed to the fourth idle sprocket 114.

As shown in FIG. 19 in detail, the second driving force transmitting mechanism 104 further includes a sun gear 118 remote from the third transmitting gear 116, a planet gear 120 which is always meshing with the sun gear 118, can revolve around the outer periphery of the sun gear 118 and is capable of meshing with the third transmitting gear 116, a fifth idle sprocket 122 coaxially fixed to the sun gear 118, a second driven sprocket 124 coaxially fixed to the second support shaft 96, and a fourth driving force transmitting chain 126 wound between the fifth idle sprocket 122 and the second driven sprocket 124.

The second driving force transmitting mechanism 102 still further includes a clutch mechanism 128 for arbitrarily transmitting the driving force from the alignment motor 72 to the third transmitting gear 116. The clutch mechanism 128 is provided with an electromagnetic solenoid 130, a coupling member 132 for coupling an actuator of the electromagnetic solenoid 130 with the planet gear 120, and lock pawl 134 connected to the actuator of the solenoid 130, for locking the rotation of the sun gear 118 when it meshes with the sun gear 118.

The actuator of the solenoid 130 is always urged by a return spring (not shown) so as to protrude from the solenoid 130. More specifically, the planet gear 120 is disengaged from the third transmitting gear 116 while the lock pawl 134 meshes with the sun gear 118 to lock the rotation thereof, in the condition where the electromagnetic solenoid 130 is deenergized and the actuator is pushed out. Accordingly, the driving force which is transmitted to the third transmitting gear 116 from the alignment motor 72 is not transmitted to the longitudinal aligning rod 46 and the longitudinal aligning rod 46 is held in the present position.

On the other hand, the planet gear 120 is engaged with the third transmitting gear 116 while the lock pawl 134 is disengaged from the sun gear 118 to release the lock thereof, in the condition where the electromagnetic solenoid 130 is energized and the actuator is retracted in. Accordingly, the driving force which is transmitted to the third transmitting gear 116 from the alignment motor 72 is transmitted to the longitudinal aligning rod 46 and the longitudinal aligning rod 46 can swing about the second support shaft 96.

Coaxially fixed to the fourth idle sprocket 114 is a transmitting shaft 138 for transmitting the driving force of the alignment motor 72 to a take-out mechanism 136 which is provided for collectively taking out the copied sheets P stacked on the sorting tray 26A in the discharge direction Y and pass the pile of the copied sheets P to the discharge mechanism 36. More specific description about the take-out mechanism 136 will be given later.

Figure 20:
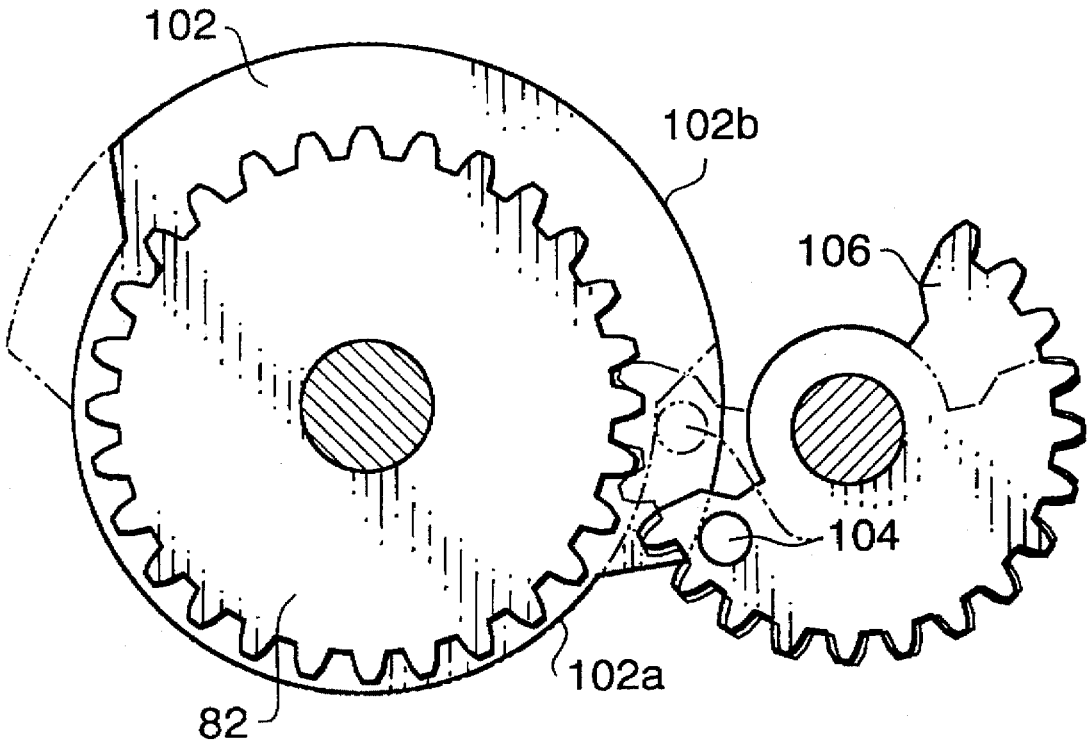
FIG. 20 is a plan view of a cam member.

As shown in FIG. 20, the cam member 102 has a small diameter portion 102*a* with a semi-circular shape, and a large diameter portion 102*b* with a semi-circular shape and a diameter larger than that of the small diameter portion 102*a*. The diameter of the small diameter portion 102*a* is set so that, when the cam follower 104 contacts the outer periphery of the small diameter portion 102*a*, the sector gear 106 can mesh with the first transmitting gear 82, thereby transmitting the driving force from the first transmitting gear 82 to the sector gear 106. The diameter of the large diameter portion 102*b* is set so that, when the cam follower 104 contacts the outer periphery of the large diameter portion 102*b*, the sector gear 106 is disengaged from the first transmitting gear 82, thereby not transmitting the driving force from the first transmitting gear 82 to the sector gear 106.

An extent of the formation of the teeth of the sector gear 106 is set to include a swinging extent of the longitudinal aligning rod 46 as well as a swinging extent of a pair of upper and lower gripping pieces 140*a* and 140*b* of the take-out mechanism 136. In other words, an extent of the formation of the small diameter portion 102*a* is defined as a driving force transmitting extent for allowing the transmission of the driving force of the alignment motor 72 to the longitudinal alignment mechanism 44 and the take-out mechanism 136 as well as the lateral alignment mechanism 40, while an extent of the formation of the large diameter portion 102*b* is defined as a driving force transmitting extent for allowing the transmission of the driving force of the alignment motor 72 only to the lateral alignment mechanism 40.

Since the second driving force transmitting mechanism 100 is constructed as described above in detail, the driving force of the alignment motor 72 can be transmitted to the third transmitting gear 116 by meshing the sector gear 106 with the first transmitting gear 82, when the first transmitting gear 82 is rotated in the prescribed extent where the small diameter portion 102*a* of the cam member 102 opposes to the cam follower 104 and both contact with each other. On the other hand, the driving force of the alignment motor 72 can not be transmitted to the third transmitting gear 116 by disengaging the sector gear 106 from the first transmitting gear 82, when the first transmitting gear 82 is rotated in the prescribed extent where the large diameter portion 102*b* of the cam member 102 opposes to the cam follower 104 and both contact with each other.

The electromagnetic solenoid 130 is deenergized when the cam follower 106 contacts the large diameter portion 102*b* of the cam member 102, and becomes to be energized when the cam follower 106 comes to contact the small diameter portion 102*a* of the cam member 102, under the control of a control unit 142 which will be mentioned later in detail.

That is to say, once the electromagnetic solenoid 130 is energized under the control of the control unit 142, where the first transmitting gear 82 meshes with the sector gear 106 to be capable of transmitting of driving force to the sector gear 106, the planet gear 120 meshes with the third transmitting gear 116 and also the lock of the sun gear 118 by the lock pawl 134 is released. Accordingly the driving force of the alignment motor 72 can be transmitted to the longitudinal aligning rod 46. On the other hand, once the electromagnetic solenoid 130 is deenergized under the control of the control unit 142 during the alignment motor 72 is being driven, the planet gear 120 is disengaged from the third transmitting gear 116 as well as the sun gear 118 is locked by the lock pawl 134. Accordingly, the longitudinal aligning rod 46 is stopped and fixed in the present position.

The control unit 142 controls the electromagnetic solenoid 130 to deenergize at a timing when the longitudinal aligning rod 46 is stopped in the longitudinal aligning position (shown by a one-dot-and-dashed line in FIG. 8). The longitudinal aligning position is defined so that the copied sheet P taken in on the sorting tray 26A abuts against the longitudinal aligning rod 46 and can be placed on the sorting tray 26A at the prescribed constant position nevertheless its size of the sheet.

Figure 5:
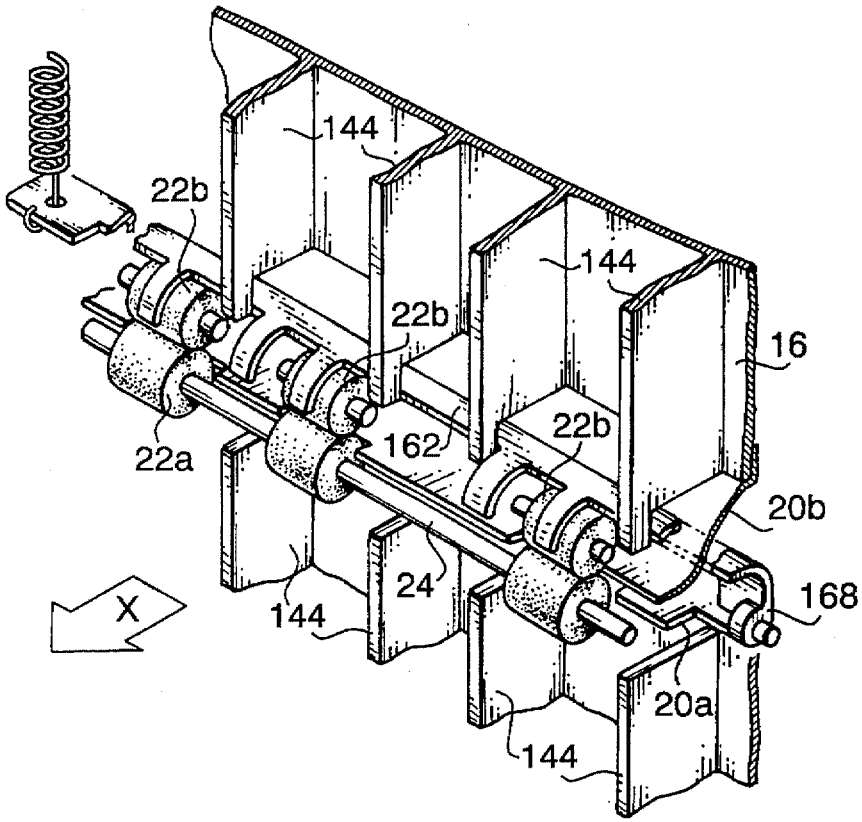
FIG. 5 is a perspective view of the take-in mechanism of the sheet post-treating apparatus.

As shown in FIG. 5 in detail, a plurality of rear restricting members 144 for restricting the rear end portion of the copied sheets P, the front end portions of which have already been restricted by the longitudinal aligning rod 46, are attached to the right hand portion of the frame 16. The rear restricting members 144 extend vertically, and divided into the upper portions and lower portions where the exit of the take-in mechanism 18 is opposed, in order to not interfere with the take-in operation of the copied sheet P by the take-in mechanism 18.

Thus, the position of the copied sheets P in the take-in direction X (that is, the longitudinal position of the copied sheets P on the sorting tray 26A) is accurately defined by being clamped between the longitudinal aligning rod 46 and the rear restricting members 144. In other words, the position of the longitudinal aligning rod 46 in the take-in direction X is precisely defined so as to be remote from the rear restricting members 144 by the length of the copied sheet P in the take-in direction X, under the control of the control unit 142.

As shown in FIG. 2, an upper end portion 46*a* of the longitudinal aligning rod 46 terminates in a position just higher than the sorting tray 26B which is positioned just above the sorting tray 26A in the treatment position. As a result, the longitudinal aligning rod 46 never interfere the take-out operation of the copied sheets P stacked on the sorting trays 26 which are positioned above the sorting tray 26B, where the take-out operation is manually executed by an operator's hand. Accordingly, the manual take-out operation of the copied sheets P, and a removal operation of the jammed sheets P on the sorting tray 26 can be done very easily.

Note that the longitudinal aligning rod 46 is returned to the home position (shown by the solid line in FIG. 3) after the copied sheets P are discharged from the sorting tray 26.

[Description of the discharge shutter mechanism 64]

The description will be given about the discharge shutter mechanism 64 for the copied sheets P pushed by the lateral aligning rod 42 in the discharge direction Y.

Figure 4:
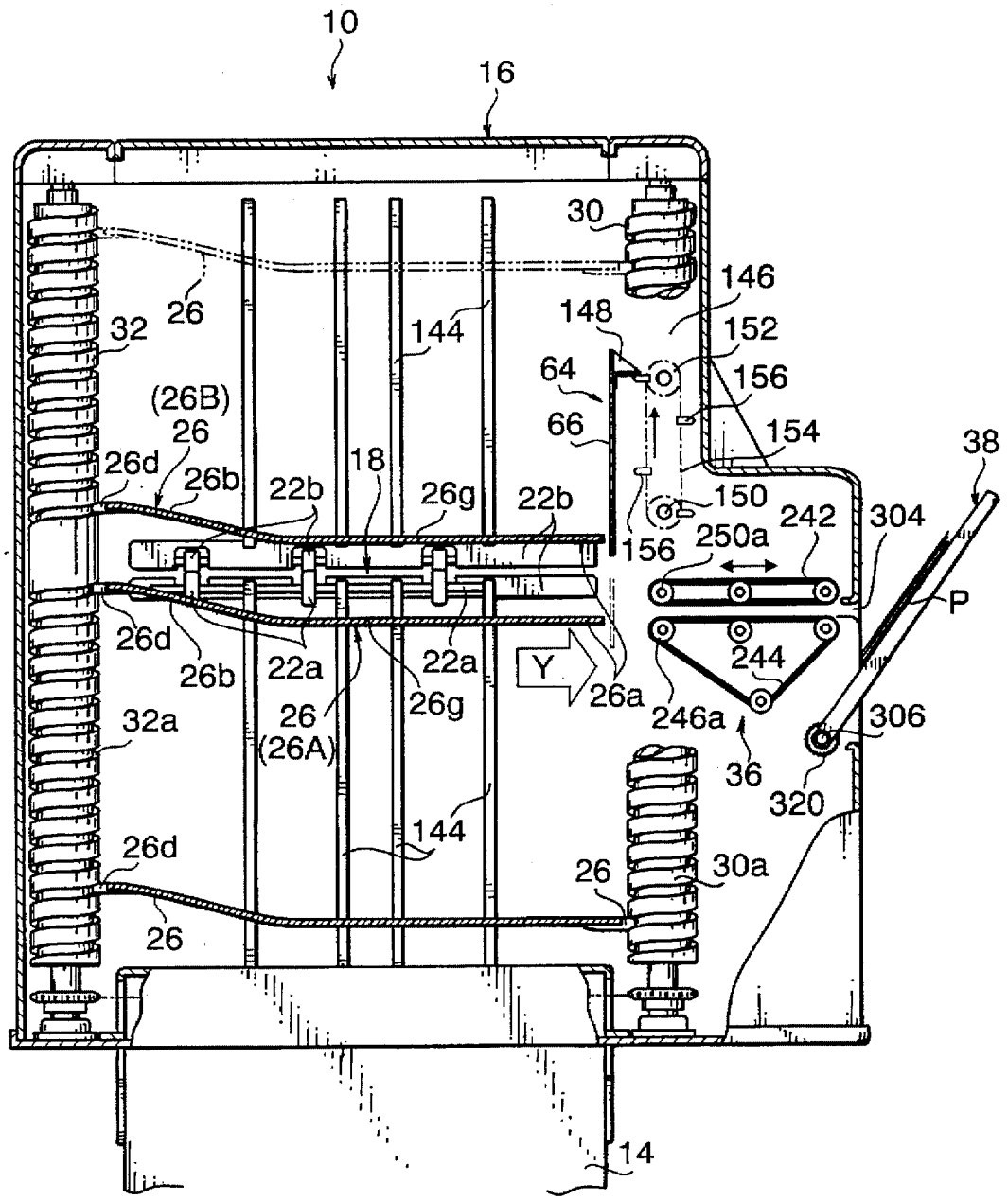
FIG. 4 is a side elevational sectional view of the sheet post-treating apparatus taken along the line III—III in FIG. 3.

As shown in FIG. 4, the discharge mechanism 36, which will be described later in detail, is arranged on the downstream side with respect to the discharge direction Y from (that is, in front of) the sorting tray 26A in the treatment position. The discharge shutter mechanism 64 generally includes a discharge shutter plate 66 which is provided between the sorting tray 26A in the treatment position and the discharge mechanism 36, and for openably closing the entrance of the discharge mechanism 36, and a discharge shutter drive mechanism 146 for driving to open the discharge shutter plate 66. The discharge shutter plate 66 is movable vertically and between a lower "close" position (shown by a two-dots-and-dashed line in FIG. 4) for closing the entrance of the discharge mechanism 36 and an upper "open" position (shown by a solid line in FIG. 4) for opening the entrance thereof.

The drive mechanism 146 generally includes a driven hook 148 fixed to the upper portion of the back face of the discharge shutter plate 66, an endless belt 154 wound between an lower driving pulley 150 and a lower driven pulley 152, and an open pawls 156 attached to the outer peripheral surface of the endless belt 154 with a prescribed pitch in a running direction thereof. Each of the open pawls 156 is engageable with the driven hook 148 and the discharge shutter plate 66 is moved upward from the close position to the open position upon the clockwise running of the endless belt 154 in a condition where one of the open pawls 156 is engaged with the driven hook 148.

Since the discharge shutter drive mechanism 146 is constructed as described above in detail, the lower driving pulley 150 is rotated clockwise by the driving force of a feed motor 158, thereby running the endless belt in the clockwise direction. Accordingly, one of the open pawls 156 comes to engage with the driven hook 148 from below and the discharge shutter plate 66 to which the driven hook 148 is fixed rises from the close position toward the open position thereby opening the entrance of the discharge mechanism 36.

On the other hand, where the endless belt 154 further runs clockwise and the open pawl 156 becomes disengaged from the driven hook 148, the discharge shutter plate 66 is moved down from the open position toward the close position by gravity or its own weight, and finally, closes the entrance of the sheets pile discharge mechanism 36 in the close position.

Note that, in the present embodiment, the sorting tray 26A in the treatment position means the sorting tray in a take-in position where the copied sheet P is directly taken in thereon by the take-in mechanism 18 as mentioned above, as well as the sorting tray in a take-out position where the copied sheets P stacked thereon are taken out therefrom by the take-out mechanism 136. It should be noted that it is not necessary the sorting tray in the take-out position coincides with the sorting tray in the take-in position and they are provided separately.

[Description of take-in shutter mechanism 160]

As mentioned above, the sorting tray 26A in the treatment position on which the copied sheets P are stacked through the take-in mechanism 18 is moved upward or downward by the tray drive mechanism 28 while the posture of each of the sorting trays 26 is maintained to be substantially horizontal. Accordingly, the pile of the copied sheets P stacked on each of the horizontal sorting trays 26 tend to collapse due to the vibration of the sorting trays 26 during the upward or downward movement.

If the collapsed sheets P enter the exit of the sheet take-in mechanism 18 they could be jammed therein. To prevent the copied sheets P from jamming in the exit of the sheet take-in mechanism 18, there is provided a take-in shutter mechanism 160 for closing the exit of the take-in mechanism 18 when the sorting trays 26 are moved upward or downward, as shown in FIGS. 2 and 5.

The take-in shutter mechanism 160 generally includes a take-in shutter plate 162 provided between the sorting tray 26*a* in the treatment position and the take-in mechanism 18 and openably closing the exit of the take-in mechanism 18, and a take-in shutter drive mechanism 164 for driving to open the take-in shutter plate 162. The take-in shutter plate 162 is movable between a lower close position (shown by a one-dot-and-dashed lien in FIG. 9) for closing the exit of the take-in mechanism 18 and an upper open position (shown by a solid line in FIG. 9) for opening the exit of the take-in mechanism 18.

Figure 9:
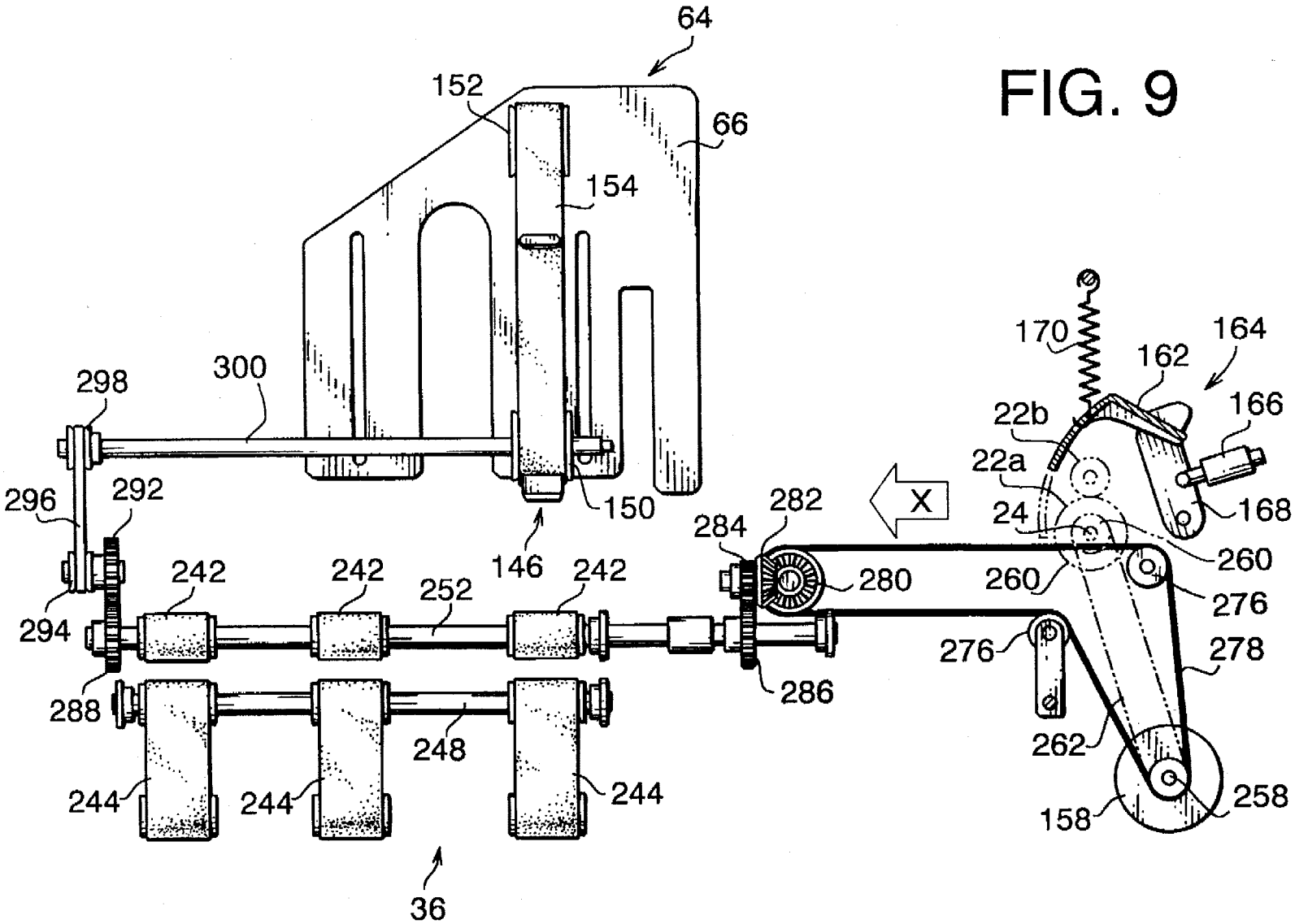
FIG. 9 is a front view showing a discharge shutter mechanism, sheets pile discharge mechanism and take-in shutter mechanism of the sheet post-treating apparatus.

As shown in FIG. 9, the take-in shutter drive mechanism 164 generally includes an electromagnetic solenoid 166 of which an actuator is retracted upon the energization thereof, a swing lever 168 which is swingably supported at the lower end thereof, the middle portion of which is connected to the distal end of the actuator of the electromagnetic solenoid 166, and the upper portion of which is integrally attached to the upper portion of the take-in shutter plate 168, and an urging member 170 for urging to swing the swing lever 168 so as to move the take-in shutter plate 162 to the open position.

Since the take-in shutter mechanism 164 is constructed as mentioned above in detail, the take-in shutter plate 162 is moved to the open position by the urging force of the urging member 170 thereby opening the exit of the take-in mechanism 18 where the electromagnetic solenoid 166 is deenergized under the control of the control unit 142. On the other hand, the take-in shutter plate 162 is moved to the close position against the urging force of the urging member 170 thereby closing the exit of the take-in mechanism 18 where the electromagnetic solenoid 166 is energized under the control of the control unit 142.

Note that it is necessary that the movement of the take-in shutter plate 162 synchronize with the rotation of the first through third screw rods 30, 32 and 34. Accordingly, the electromagnetic solenoid 116 may be mechanically controlled by a switch (not shown) which is opened/closed by a cam member (not shown) fixed to the one of the first through third screw rods 30, 32 and 34 or first support shaft 68 of the lateral alignment mechanism 40, without controlled by the control unit 142.

Further, the take-in shutter plate 162 may be mechanically moved between the open position and the close position by a cam member (not shown). The cam member is arranged between the first and third screw rods 30 and 34, and is biased during the rotation of the first and third screw rods 30 and 34 to actuate a driven portion (not shown) integrally attached to the take-in shutter plate 162 thereby moving the take-in shutter plate 162 between the open position and the close position, without using the electromagnetic solenoid 116 as a driving source. By constructing the drive mechanism of the take-in shutter plate 162 without using the electromagnetic solenoid 116, the manufacturing cost of the sheet post-treating apparatus 10 can be reduced.

[Description of take-out mechanism 136]

As shown in FIG. 3, a recessed portion **26*h* into which a pair of upper and lower griping pieces 140*a* and 140*b* of the take-out mechanism 136 are capable of inserting is formed to a sorting tray 26 on the right and front side thereof. The copied sheets P stacked on the sorting tray 26A in the treatment position are collectively gripped by the upper and lower griping pieces 140*a* and 140*b* at those portions thereof which are positioned in the recessed portion 26*h***.

The take-out mechanism 136 is constructed so that the copied sheets P gripped by the griping pieces **140*a* and 140*b* are taken out from the sorting tray 26A in the discharge direction Y without altering its posture and transferred to the discharge mechanism 36 which is arranged in front of the sorting tray 26**A in the treatment position, that is, on the downstream side with respect to the discharge direction Y.

Figure 6:
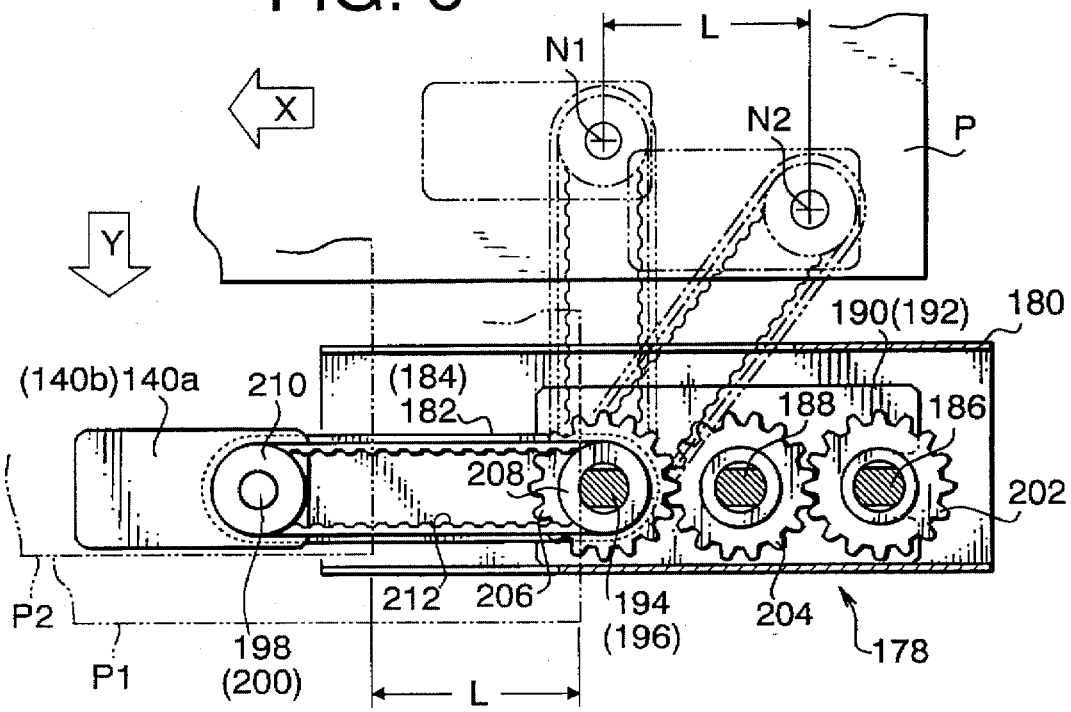
FIG. 6 is a plan view of a gripper mechanism of the sheet post-treating apparatus.
Figure 7:
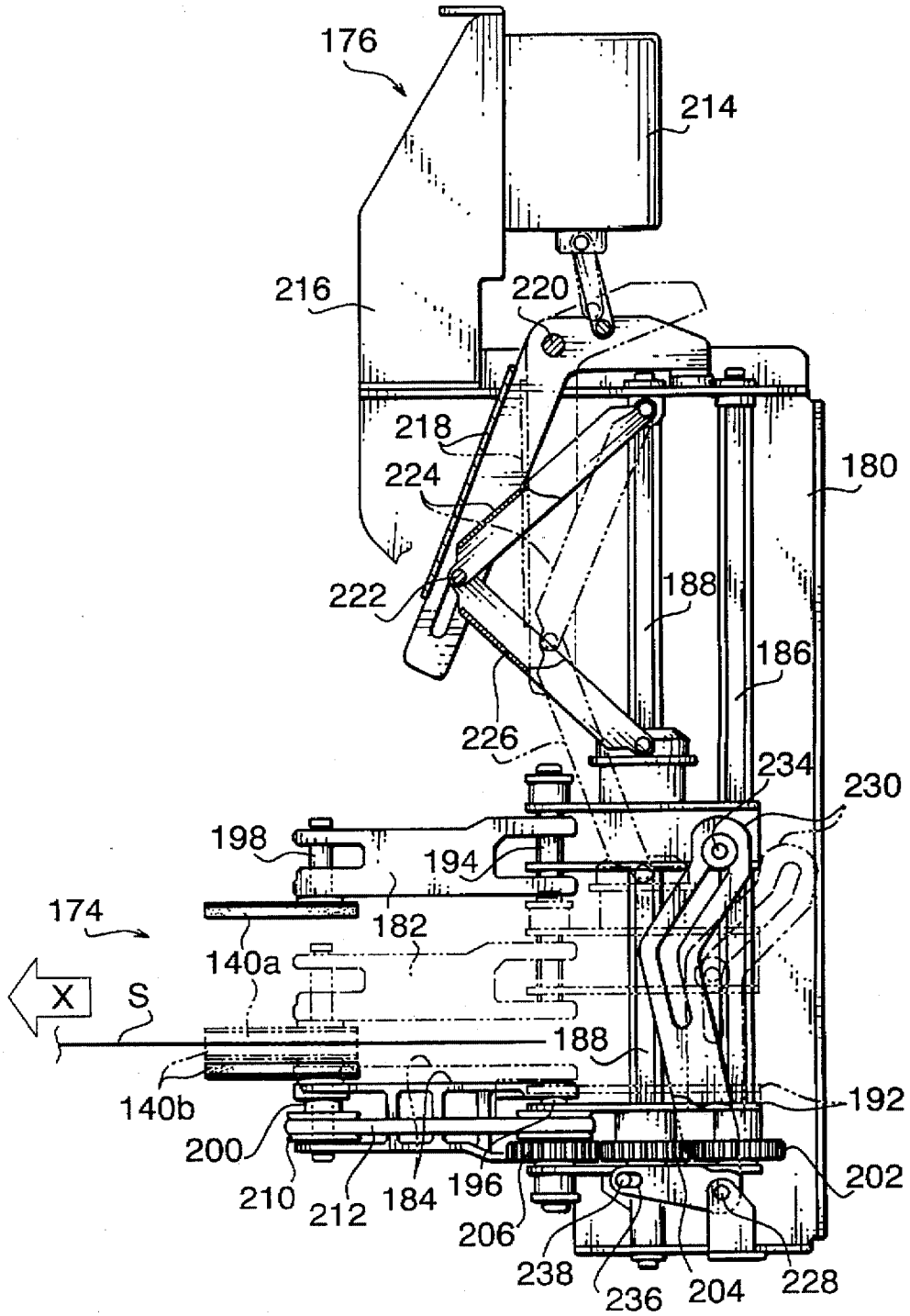
FIG. 7 is a front view showing the gripper mechanism.

As shown in FIGS. 6 and 7, the take-out mechanism 136 generally includes a gripper unit 174 having the upper and lower griping pieces **140*a* and 140*b*, a gripper driving mechanism 176 for driving to grip the copied sheets P stacked on the sorting tray 26A in the treatment position, and a gripper moving mechanism 178 for moving the gripper unit 174 in the horizontal plane without altering the posture thereof to the discharge mechanism 36**.

As mentioned later in detail, the gripper driving mechanism 176 and the gripper moving mechanism 178 are controlled by the control unit 142 so that the nip position to the copied sheets P stacked on the sorting tray 26A is changed according to different discharge positions in the discharge mechanism 36.

As shown in FIGS. 6 and 7, the gripper unit 174 generally includes a gripper frame 180 fixed in front of the frame 16, a pair of upper and lower gripper arms 182 and 184 which are rotatable in an integral manner and movable independently in the vertical direction. The upper and lower gripping pieces **140*a* and 140*b* are rotatably connected to the distal ends of the upper and lower gripper arms 182 and 184, respectively. The copied sheets P stacked on the sorting tray 26A are selectively gripped by the upper and lower gripping pieces 140*a* and 140*b*** at different grip positions N1 and N2 which are apart from each other by a distance L in the take-in direction X.

The upper and lower gripping pieces **140*a* and 140*b* are driven to release the copied sheets P in a common home position (shown by a solid line in FIGS. 3 and 6) in the discharge mechanism 36. As a result, as shown in FIG. 6, a released position P1 in the home position of the copied sheets P which are gripped in the first grip position N1 is set to be apart from a released position P2** by the distance L in the take-in direction X in the same home position of the copied sheets P which are gripped in the second grip position N2, thereby being jogged (that is, the jogging treatment is executed).

[Description of gripper moving mechanism 178]

The description will be given about the gripper moving mechanism 178 at first, and then about the gripper driving mechanism 176, with reference to the drawings of FIGS. 6 and 7.

In the gripper moving mechanism 178, a pair of right and left guide rods 186 and 188 which extend vertically and are apart from each other in the take-in direction X are fixed to the gripper frame 180. A pair of upper and lower movable rests 190 and 192 are attached to the guide rods 186 and 188 in such a manner that they are movable vertically along the guide rods 186 and 188. A pair of proximal side support shafts 194 and 196 are rotatably attached to the distal ends of the upper and lower movable rests 190 and 192, respectively. The proximal side support shafts 194 and 196 are rotatable about the vertical axis and aligned in the vertical axis. The upper and lower gripper arms 182 and 184 are fixed to the proximal side support shafts 194 and 196 at the proximal ends thereof, respectively.

A pair of distal side support shafts 198 and 200 are rotatably attached to the distal ends of the upper and lower gripper arms 182 and 184, respectively. The distal side support shafts 198 and 200 are rotatable about the vertical axis and aligned with the vertical axis. The upper gripping piece **140*a* is fixed to the lower end of the upper distal side supporting shaft 198 and the lower gripping piece 140*b* is fixed to the upper end of the lower distal side supporting shaft 200**.

Since the driving structures for the upper and lower gripping pieces **140*a* and 140*b*, respectively, are set to be identical, the description about the driving structure for the lower gripping piece 140*b* will only be given as follows and the description about the driving structure for the upper gripping piece 140*a*** will be omitted.

A driven gear 202 is rotatably fitted to the right guide rod 186 and positioned to be lower than the upper movable rest 192. An intermediate gear 204 is rotatably fitted to the left guide rod 188 and meshed with the driven gear 202. A control gear 206 is coaxially fixed to the lower proximal side support shaft 196 and meshed with the intermediate gear 204.

A proximal side sprocket 208 is coaxially and rotatably fitted to the proximal side support shaft 196 and fixed to the lower movable rest 192. A distal side sprocket 210 is coaxially fixed to the distal side support shaft 200. An endless timing belt 212 is wound between the proximal side sprocket 208 and distal side sprocket 210. The proximal side sprocket 208 and the distal side sprocket 210 are formed to be identical so that they are rotated simultaneously with each other by the timing belt 212.

As shown in FIG. 19, the driven gear 202 is meshed with a transmitting gear 172 attached to a transmitting shaft 138 which is coaxially fixed to the fourth idle sprocket 114. Accordingly, the driven gear 202 is driven to rotate upon the rotation of the fourth idle sprocket 114 by the alignment motor 72.

Since the gripper moving mechanism 178 is constructed as mentioned above in detail, when the driven gear 202 is rotated clockwise as shown in FIG. 6, the upper and lower gripper arms 182 and 184 are rotated simultaneously and clockwise from the home position (shown by a solid line in FIG. 6) to the first or second nip position N1 or N2 (shown by a two-dots-and-dashed line in FIG. 6). On the other hand, the proximal side support shafts 196 are relatively rotated counterclockwise to the proximal side support shafts 196 upon the clockwise rotation of the gripper arms 182 and 184 because the proximal side support shafts 208 are fixed to the corresponding movable rests 190 and 192.

As a result, the pair of griping pieces 140*a* and 140*b* are rotated counterclockwise about the corresponding distal side support shafts 200. Accordingly, the posture of each of the gripping pieces 140*a* and 140*b* in the first or second nip position N1 or N2 is not altered from that in the home position P1 or P2. Inversely, the posture of each of the gripping pieces 140*a* and 140*b* in the home position P1 or P2 is not altered from that in the first or second nip position N1 or N2. That is, the copied sheets P gripped by the gripping pieces 140*a* and 140*b* of the gripper unit 174 is taken out from the sorting tray 26A in the treatment position to the discharge mechanism 36 in the discharge direction Y without altering the posture thereof.

[Description of gripper driving mechanism 176]

The description will be given about the gripper driving mechanism 176 for driving the upper and lower gripping pieces 140*a* and 140*b* to approach each other thereby gripping the copied sheets P therebetween.

An electromagnetic solenoid 214 is disposed on the upper portion of the gripper frame 180 through an attaching stay 216. The electromagnetic solenoid 214 is controlled to be energized/deenergized by the control unit 142. A coupling link 218 is provided just below the electromagnetic solenoid 214. The middle portion of the coupling link 218 is rotatably supported to the upper surface of the gripper frame 180 through a support shaft 220 about the horizontal axis.

The lower end of an actuator of the electromagnetic solenoid 214 is coupled to the upper portion of the coupling link 218. The coupling link 218 is bent by a predetermined obtuse angle at the middle portion to which the support shaft 200 is attached. The lower end of the coupling link 218 extends below the upper portion of the gripper frame 180.

A pair of upper and lower toggle links 224 and 226 are rotatably supported to the lower end portion of the coupling link 218 through a common support shaft 222 at the proximal end thereof. The distal end of the upper toggle link 224 is rotatably supported to the upper portion of the left guide rod 188. The distal end of the lower toggle link 226 is fixed to the upper surface of the upper movable rest 190.

The middle portion of a connecting link 230 is rotatably supported to the under surface of the gripper frame 180 through a support shaft 228. The connecting link 230 is provided for moving vertically the lower movable rest 192 upon the vertical movement of the upper movable rest 190. A prescribed shaped cam groove 232 is formed to the upper portion of the connecting link 230. A pin 234 passing through the cam groove 232 is fixed to the front surface of the upper movable rest 190. An elongate groove 236 is formed to the lower portion of the connecting link 230. A pin passing through the elongate groove 236 is fixed to the front surface of the lower movable rest 92.

Since the gripper driving mechanism 176 is constructed as mentioned above in detail, the upper movable rest 190 is pushed down from a home position (shown by a solid line in FIG. 7) to a gripping position (shown by a two-dots-and-dashed line in FIG. 7) along the right and left guide rods 186 and 188 when the electromagnetic solenoid 214 is once energized to rotate the coupling link 218' about the support shaft 220 from a home position (shown by a two-dots-and-dashed line in FIG. 7) to a gripping position (shown by a solid line in FIG. 7).

In accordance with the descent of the upper movable rest 190, the lower movable rest 192 is pushed up from a home position (shown by a solid line in FIG. 7) to a gripping position (shown by a two-dots-and-dashed line in FIG. 7) along the right and left guide rods 186 and 188 through the connecting link 230. As a result, the upper and lower gripping pieces 140*a* and 140*b* vertically grip those portions of the copied sheets P stacked on the sorting tray 26A which portions are located in the recessed portion 26*h*.

[Description of discharge mechanism 36]

As shown in FIGS. 3 and 4, the discharge mechanism 36 is arranged in front of the sorting tray 26A in the treatment position. The discharge mechanism 36 is constructed to collectively discharge a pile of the copied sheets P which are collectively taken out from the sorting tray 26A in the treatment position by the take-out mechanism 136, in the discharge direction Y and send the piles successively onto the discharge tray 38.

The discharge mechanism 36 generally includes a pair of upper and lower discharge belts 242 and 244. The lower discharge belt 244 is wound around a plurality of rollers 246 so as to have a horizontal surface at the upper portion thereof where the horizontal surface is set to be substantially flush with the upper surface of the sorting tray 26A in the treatment position. One of the rollers 246 is a driving roller 246*a* to which a lower roller driving shaft 244 is coaxially fixed.

The upper discharge belt 242 is wound around a plurality of rollers 250 so as to have a horizontal surface at the lower portion thereof which is located just above the horizontal surface of the lower discharge belt 244. One of the rollers 250 is a driving roller 250*a* to which an upper roller driving shaft 252 is coaxially fixed.

Note that the upper discharge belt 242 is movable vertically relative to the lower discharge belt 244, and moved upward or downward corresponding to the thickness of the pile of the copied sheets P which is to be discharged by the discharge mechanism 36, under the control of the control unit 142.

[Description of driving force transmitting system for discharge mechanism 36]

A driving force transmitting system for the discharge mechanism 36 generally includes a driving force transmitting mechanism 254 for transmitting the driving force of the feed motor 158 to the lower discharge belt 244 and a driving force transmitting mechanism 256 for transmitting the driving force of the feed motor 158 to the upper discharge belt 242.

The feed motor 158 is used as a drive source of the discharge mechanism 36 as well as the take-in mechanism 18 (that is, to rotate the lower take-in roller 22*a*) and the discharge shutter mechanism 64 (that is, to open the discharge shutter plate 66), in the present embodiment. Accordingly, the description will be given about the driving force transmitting mechanism for the discharge mechanism 36 as well as the take-in mechanism 18 and the discharge shutter mechanism 64.

Figure 10:
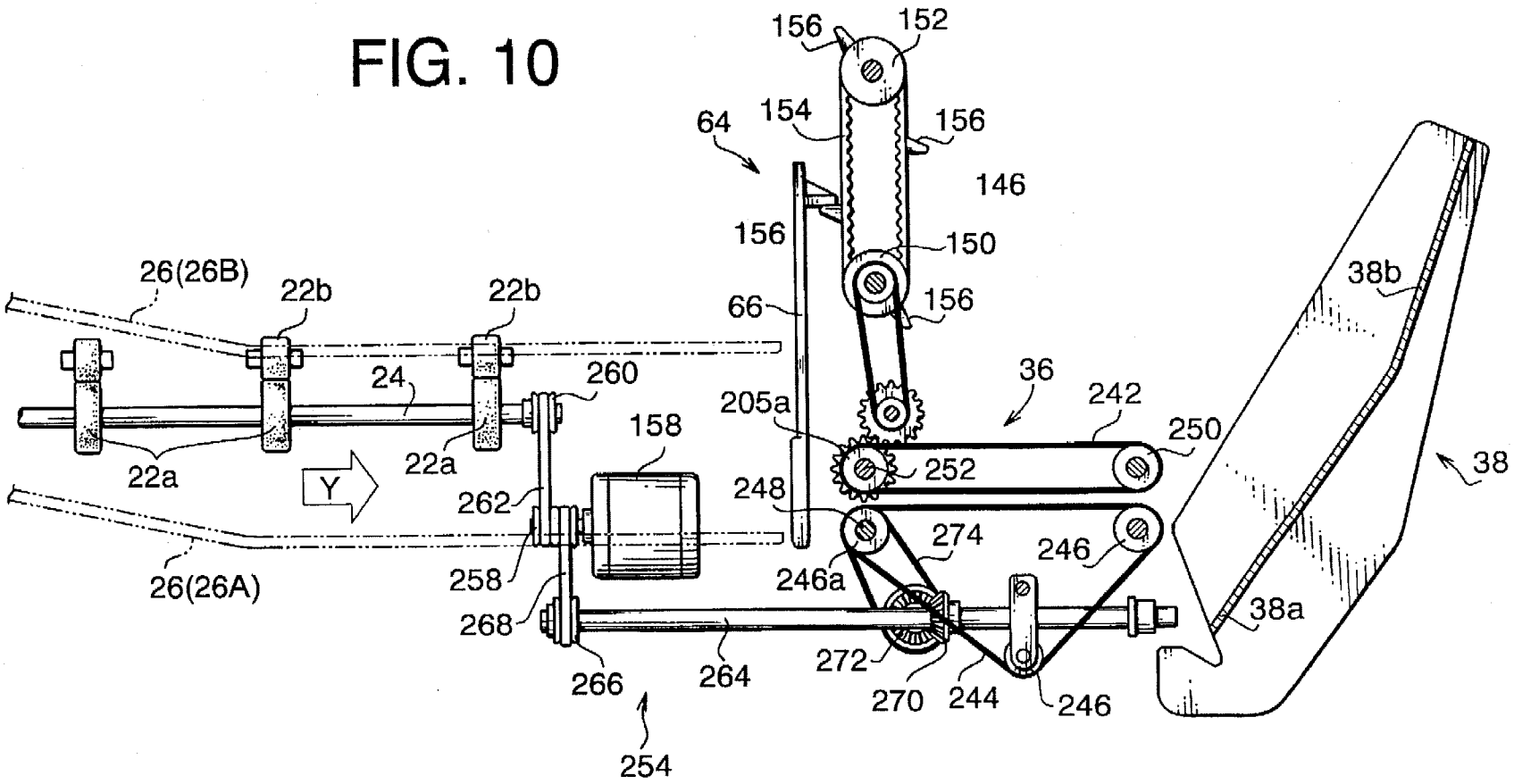
FIG. 10 is a side view showing a driving system of the discharge shutter mechanism, sheets pile discharge mechanism and take-in shutter mechanism.
Figure 11:
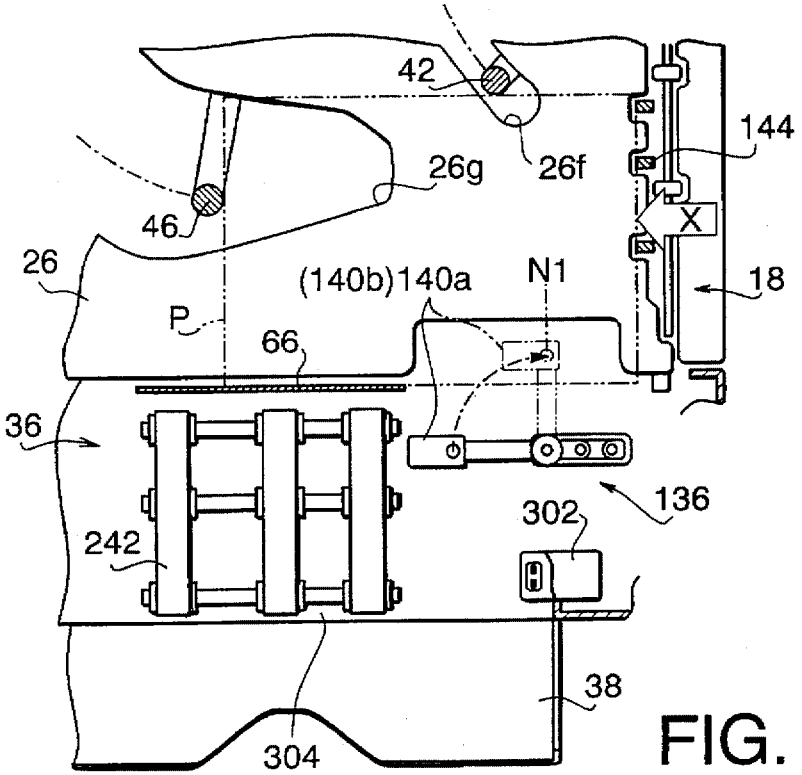
FIG. 11 is a plan view schematically showing the sheets pile discharge mechanism in a initial condition of the jogging treatment.
Figure 12:
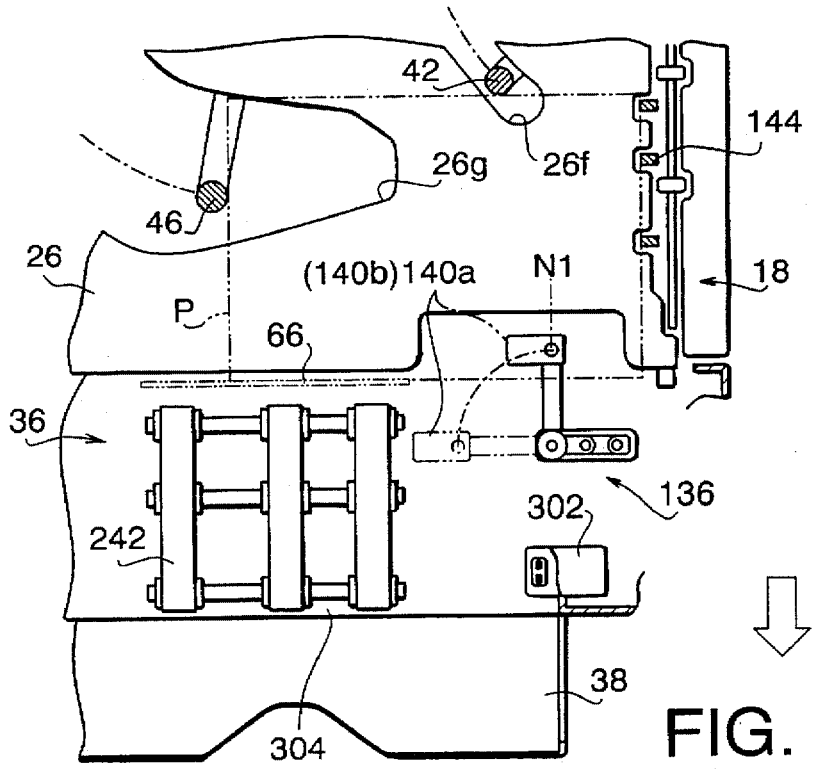
FIG. 12 is a plan view schematically showing the sheets pile discharge mechanism in a condition where the jogging treatment is initiated and gripping pieces are moved to the first nip position.

As shown in FIGS. 9 and 10, the feed motor 158 is mounted on the frame 16 so that the motor shaft thereof extends in the discharge direction Y. The driving force transmitting mechanism for the take-in mechanism 18 generally includes a first driving pulley 258 which is coaxially fixed to the motor shaft of the feed motor 158, a first driven pulley 260 which is coaxially fixed to the take-in drive shaft 24 to which the lower take-in roller 22*a* is coaxially fixed, and a first endless belt 262 which is wound between the first driving pulley 258 and the first driven pulley 26.

Since the driving force transmitting mechanism for the take-in roller 22*a* of the take-in mechanism 18 is constructed as mentioned above, the take-in roller 22*a* is rotated so as to take in the copied sheet P transferred from the electrostatic copying machine 400 onto the sorting tray 26A in the take-in direction X.

As shown in FIG. 10, The driving force transmitting mechanism 254 for the lower discharge belt 244 generally includes a first transmitting shaft 264 which is arranged to be parallel to the motor shaft of the feed motor 158, a first intermediate pulley 266 which is coaxially fixed to one end of the first transmitting shaft 264, a second endless belt 268 which is wound between the first intermediate pulley 266 and the aforementioned driving pulley 258, a first bevel gear 270 which is attached to the other end of the first transmitting shaft 264, and a second bevel gear 272 which is meshed with the first bevel gear 270.

The driving force transmitting mechanism 254 for the lower discharge belt 244 further includes a second intermediate pulley (not shown) which is coaxially fixed to the second bevel gear 272, a second driven pulley (not shown) which is coaxially fixed to the aforementioned lower roller driving shaft 248, and a third endless belt 274 which is wound between the second intermediate pulley and the second driven pulley.

Since the driving force transmitting mechanism 254 for the lower discharge belt 244 or lower roller driving shaft 248 is constructed as mentioned above in detail, the lower roller driving shaft 248 is rotated to discharge the pile of the copied sheets P taken out from the sorting tray 26A by the take-out mechanism 136 in the discharge direction Y to the front side when the feed motor 158 is driven to rotate the motor shaft in a normal direction, while the lower roller driving shaft 248 is rotated to retract the pile of the copied sheets P in a reverse direction opposite to the discharge direction Y toward the sorting tray 26A when the feed motor 158 is driven to rotate the motor shaft in a reverse direction.

As shown in FIG. 9, the driving force transmitting mechanism 256 for the upper discharge belt 242 generally includes a plurality of idle pulleys 276 of which each of the rotating axis is set to be parallel to the motor shaft of the feed motor 158, a third intermediate pulley (not shown), a second driving pulley 258 which is coaxially fixed to the motor shaft of the feed motor 158, a fourth endless belt 278 which is wound around the idle pulleys 276 and the third intermediate pulley, a third bevel gear 280 which is coaxially fixed to the third intermediate pulley, a fourth bevel gear 282 which is meshed with the third bevel gear 280 and which is rotatable about an axis extending in the take-in direction X, a transmitting gear 284 which is coaxially fixed to the fourth bevel gear 282, and a driven gear 286 which is meshed with the transmitting gear 284 and coaxially fixed to one end of the upper roller driving shaft 252.

Since the driving force transmitting mechanism 256 for the upper discharge belt 242 or upper roller driving shaft 252 is constructed as mentioned above in detail, the upper roller driving shaft 252 is rotated to discharge the pile of the copied sheets P taken out from the sorting tray 26A by the take-out mechanism 136 in the discharge direction Y to the front side simultaneously with the lower roller driving shaft 248 when the feed motor 158 is driven to rotate the motor shaft in the normal direction, while the upper roller driving shaft 252 is rotated to retract the pile of the copied sheets P in the reverse direction toward the sorting tray 26A simultaneously with the lower roller driving shaft 248 when the feed motor 158 is driven to rotate the motor shaft in the reverse direction.

The driving force transmitting mechanism for the discharge shutter mechanism 64 generally includes a first transmission gear 288 which is coaxially fixed to the other end of the upper roller driving shaft 252, a second transmission gear 292 which is meshed with the first transmission gear 288, a fourth intermediate pulley 294 which is coaxially fixed to the second transmission gear 292, a sixth endless belt 296 which is wound between the fourth intermediate pulley 294 and a third driven pulley 298, and a second transmitting shaft 300 to one end of which the third driven pulley 298 is coaxially fixed to the other end of which the driving pulley 150 of the discharge shutter mechanism 64 is coaxially fixed.

Since the driving force transmitting mechanism for the discharge shutter mechanism 64 is constructed as mentioned above in detail, the discharge shutter plate 66 is moved to open the entrance of the discharge mechanism 36 upon the rotation of the motor shaft of the feed motor 158.

[Description of stapler mechanism 302]

As shown in FIG. 3, a stapler mechanism 302 in which a multiple of staples S are contained for binding the pile of the copied sheets P is arranged on the right side of the discharge mechanism 136 and on the downstream side with respect to the discharge direction Y from the take-out mechanism 136.

The stapler mechanism 302 is constructed so that the pile of the copied sheets P which was taken out from the sorting tray 26A in the treatment position by the take-out mechanism 136 to the first discharge position P1 and is being discharged by the discharge mechanism 36 only is bound at the right side portion thereof by at least one staple S. Namely, the stapler mechanism 302 can bind the pile of the copied sheets P which is taken out from the sorting tray 26A into the first discharge position P1 and can not bind the pile of the copied sheets P which is taken out form the sorting tray 26A into the second discharge position P2.

Note that the construction of the stapler mechanism 302 is well known, accordingly the detailed description is omitted. Further note that since the stapler mechanism 302 is provided in a specific wide area outside the moving area of the take-out mechanism 36, a plurality of stapler mechanisms can be arranged.

[Description of discharge tray 38]

As shown FIG. 4, the discharge tray 38 to which the pile of the copied sheets P discharged by the discharge mechanism 36 through a discharge port 304 is connected to the front of the frame 16 in such a manner that the discharge tray 38 is capable of swinging about a support shaft 306. The discharge tray 38 extends in a slanted manner so that the proximal end 38*a* thereof is lower than the discharge port 304 and the distal end 38*b* thereof is higher than the discharge port 304. More specifically, the discharge tray 38 is inclined to the horizontal surface and parallel to a horizontal line perpendicular to the discharge direction Y.

Since each of the plurality of the sorting trays 26 is set to be substantially horizontal as mentioned above in detail, it is not necessary to set the discharge tray 38 to be horizontal even though the jogging treatment is executed. Accordingly, in the present embodiment, the size of the sheet post-treating apparatus 10 in the discharge direction Y can be reduced relative to prior sheet post-treating apparatus which include a discharge tray attached to the front surface of the frame in such a manner that it meets at right angles to the front surface of the frame.

As mentioned above, the discharge tray is capable of swinging about the support shaft 306. The support shaft 306 is fixed to the proximal end of the discharge tray 38 and disposed inside or retracted into the frame 16, not on the side surface of the frame 16. The discharge tray 38 is driven to swing about the support shaft 306 by a discharge tray drive mechanism 308 which will be mentioned later.

[Description of discharge tray drive mechanism 308]

Figure 21:
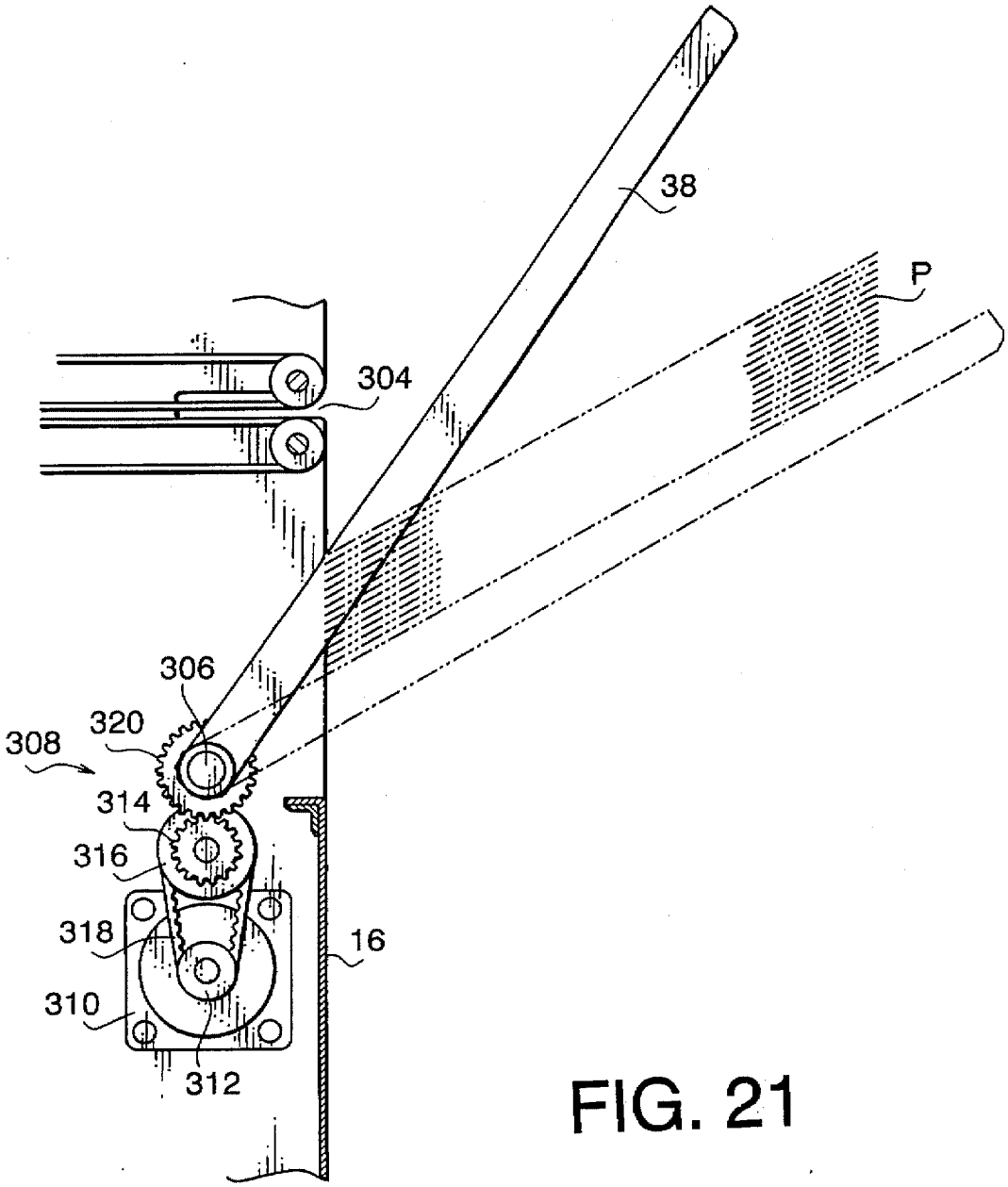
FIG. 21 is a side view showing a discharge tray and a drive mechanism for swinging the discharge tray.

As shown in FIG. 21, the discharge tray drive mechanism 308 generally includes a discharge tray drive motor 310 as a driving source, a driving pulley 312 coaxially fixed to a motor shaft of the discharge tray drive motor 310, a driven pulley 136 to which a driving gear 314 is coaxially fixed, an endless driving force transmitting belt 318 wound between the driving pulley 312 and the driven pulley 136, and a driven gear 320 coaxially fixed to the support shaft 306 and meshed with the driving gear 314.

Since the discharge tray drive mechanism 308 is constructed as described above, the discharge tray 38 can swing between an upper limit position (or home position) shown by a solid line in FIG. 21, and a lower limit position shown by a two-dots-and-dashed line, upon the drive of the discharge tray drive motor 310. The upper limit position (or home position) is defined so that there are any copied sheets P discharged by the discharge mechanism 36 on the discharge tray 38.

The discharge tray drive motor 310 is electrically connected to the control unit 142 to be controlled thereby. That is, the control unit 142 controls the discharge tray drive motor 310 gradually in clockwise direction so that an uppermost paper sensor 350 (which will be mentioned later) is always turned off by the upper surface of the pile of the copied sheets P discharged on the discharge tray 38, whereby the vertical distance between the discharge port 302 and the proximal end of the upper surface of the pile of the copied sheets P placed on the discharge tray 38 is maintained to a predetermined constant value in spite of the number of the copied sheets P or the thickness of the pile of the copied sheets P placed on the discharge tray 38.

Accordingly, a multiple of the copied sheets P are capable of being discharged and certainly placed on the discharge tray 38 in the present embodiment.

[Description of control system]

Figure 22:
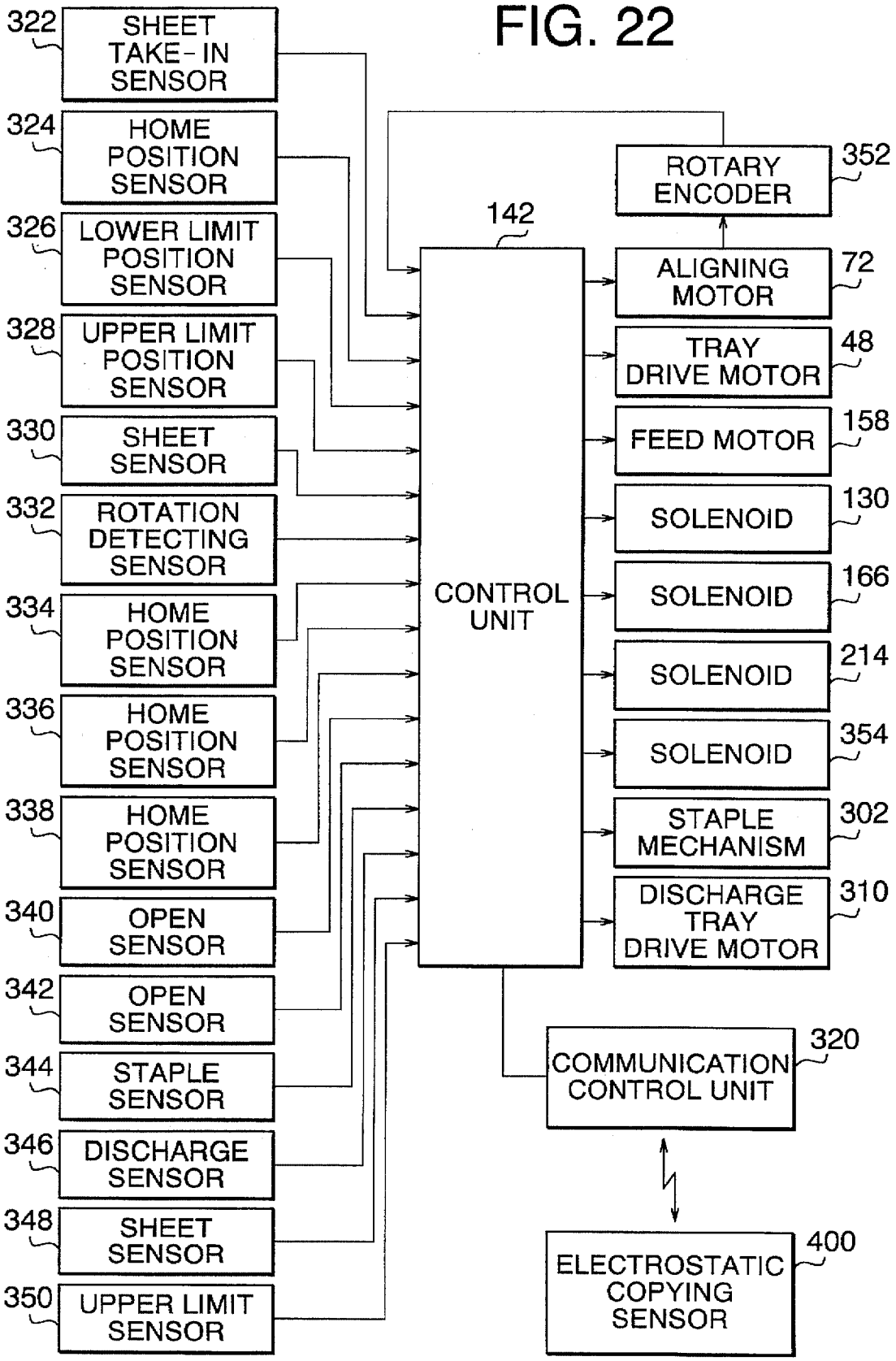
FIG. 22 is a block diagram showing a construction of a control system of the sheet post-treating apparatus.

Now, the description will be given about a control system including the control unit 142 with reference to FIG. 22.

The control unit 142 controls many actuators to execute the sorting treatment, the grouping treatment, the jogging treatment and the staple treatment, based on a variety of control signals sent from the electrostatic copying machine 400 through a communication control unit 320 and a variety of signals detected by many sensors which will be mentioned later.

At first, the description will be given about a plurality of sensors and then about a plurality of actuators.

A sheet take-in sensor 322 is arranged at the exit of the take-in mechanism 18, for being turned on by the copied sheet P which is taken in by the take-in mechanism 18. The control unit 142 detects that the copied sheet P is taken in by the take-in mechanism 18 when the sensor 322 is turned on. A sorting tray home position sensor 324 is arranged on the lower side of the tray driving mechanism 28, for defining a home position of the lowermost sorting tray 26. The sensor 324 is turned on by the lowermost sorting tray 26 when the uppermost sorting tray 26 is moved to the treatment position. The control unit 142 detects that the lowermost sorting tray 26 is located in the home position as well as the uppermost sorting tray 26 is located in the treatment position when the sensor 324 is turned on.

A sorting tray lower limit position sensor 326 is arranged on the lower side of the sorting tray home position sensor 324, for defining a lower limit position of the lowermost sorting tray 26. The sensor 326 is turned on by the lowermost sorting tray 26 when it is moved to the lower limit position. The control unit 142 detects that the lowermost sorting tray 26 is located in the lower limit position and controls to stop the drive of the tray drive mechanism 28 when the sensor 326 is turned on.

A sorting tray upper limit position sensor 328 is arranged on the upper side of the tray drive mechanism 28, for defining an upper limit position of the uppermost sorting tray 26. The sensor 328 is turned on by the uppermost sorting tray 26 when it is moved to the upper limit position. The control unit 142 detects that the uppermost sorting tray 26 is located in the upper limit position and controls to stop the drive of the tray drive mechanism 28 when the sensor 328 is turned on.

A sheet presence discrimination sensor 330 for the sorting trays 26 is provided to the sorting trays 26, for discriminating whether or not at least one copied sheet P is placed on at least the sorting tray 26A in the treatment position. The sensor 330 is turned on by at least one copied sheet P placed on the sorting tray 26A in the treatment position. The control unit 142 detects that at least one copied sheet P is placed or remained on at least sorting tray 26A in the treatment position when the sensor 330 is turned on.

A rotation detecting sensor 332 for the screw rods 30, 32 and 34 is provided to the first screw rod 30, for detecting one rotation of the first screw rod 30 about the vertical axis. The sensor 332 is turned on every each rotation of the first screw 30. The control unit 142 detects that the first to third screw rods 30, 32 and 34 are rotated by one rotation about the vertical axes thereof, respectively, whereby the each of the sorting trays 26 is moved upward or downward by a predetermined single pitch when the sensor 332 is turned on.

A longitudinal aligning rod home position sensor 334 is arranged for defining a home position of the longitudinal aligning rod 46. The sensor 334 is turned on by the second swing arm 98 to which the longitudinal aligning rod 46 is attached when it is moved to the home position thereof. The control unit 142 detects that the longitudinal aligning rod 46 is located in the home position when the sensor 334 is turned on.

A lateral aligning rod home position sensor 336 is arranged for defining a home position of the lateral aligning rod 42. The sensor 336 is turned on by the first swing arm 70 to which the lateral aligning rod 42 is attached when it is moved to the home position thereof. The control unit 142 detects that the lateral aligning rod 42 is located in the home position when the sensor 336 is turned on.

A gripper home position sensor 338 is arranged for defining a home position of each of the upper and lower gripping pieces **140*a* and 140*b*. The sensor 338 is turned on by the lower gripper arm 184 to which the upper and lower gripping pieces 140*a* and 140*b* are connected when they are moved to the home position. The control unit 142 detects that the gripping pieces 140*a* and 140*b* are located in the home position when the sensor 338** is turned on.

An open sensor 340 for the discharge shutter plate 66 is provided to the discharge shutter mechanism 64 and turned on by the discharge shutter plate 66 when it is raised to the open position. The control unit 142 detects that the discharge shutter plate 66 is moved to the open position and the entrance of the discharge mechanism 36 is opened when the sensor 340 is turned on.

An open sensor 342 is provided for the discharge mechanism 36, for detecting the open condition of the upper discharge belt 256 relative to the lower discharge belt 254 and turned on by the upper discharge belt 256 when it is moved upward and separated from the lower discharge belt 254 by a predetermined distance. The control unit 142 detects that the upper discharge belt 256 is raised from the lower discharge belt 254 to be able to discharge the pile of the copied sheets P taken out by the take-out mechanism 136 from the sorting tray 26A in the treatment position.

A staple sensor 344 is provided on the way of a discharge path which is defined between the lower and upper discharge belts 242 and 244, for defining a timing of the actuation of the stapler mechanism 302, and turned on by the pile of the copied sheets P which is being discharged by the discharge mechanism 36. The control unit 142 controls the stapler mechanism 302 to actuate on two different timings after the sensor 344 is turned on thereby binding the pile of the copied sheets P through two staples S.

A discharge sensor 346 is provided on the exit of the discharge mechanism 36, for detecting if the pile of the copied sheets P is discharged to the discharge tray 38, and turned on by the pile which is being discharged to the discharge tray 36. The control unit 142 detects that the pile is discharged to the discharge tray 38 when the sensor 346 is turned on.

A sheet presence discrimination sensor 348 for the discharge trays 38 is provided to the discharge trays 38, for discriminating whether or not at least one copied sheet P is placed on the discharge tray 36. The sensor 348 is turned on by at least one copied sheet P placed on the discharge tray 36. The control unit 142 detects that at least one copied sheet P is placed on the discharge tray 36 when the sensor 348 is turned on.

The uppermost paper sensor 350 for detecting the upper surface of the pile of the copied sheets P discharged on the discharge tray 38 is provided to the discharge tray 38. The sensor 350 is turned on by the upper surface of the pile of the copied sheets P placed on the discharge tray 38 when the thickness of the pile reaches a predetermined value which causes the proximal end of the upper surface of the pile to be lowered from the discharge port 302 by a predetermined distance.

The control unit 142 detects that the upper surface of the pile reached the predetermined upper limit position and the following sheets P which are to be discharged onto the pile of the copied sheets P previously placed on the discharge tray 38 may be jammed when the sensor 350 is turned on and controls to drive the discharge tray drive motor 310 to rotate clockwise until the sensor 350 is turned off. Accordingly, the distance between the discharge port 302 and the proximal end of the upper surface of the pile of the sheets P placed on the discharge tray 38 is surely maintained to the predetermined constant value.

Next, the description will be given about the variety of the actuators which are connected to the control unit 142 and controlled thereby.

The alignment motor 72 as a driving source of the lateral alignment mechanism 40, the longitudinal alignment mechanism 44 and the gripper movement mechanism 178 is connected to the control unit 142. The amount of the rotation of the alignment motor 72 is detected by the control unit 142 through a rotary encoder 352 which is connected to the motor shaft of the alignment motor 72. The control unit 142 controls the gripper movement mechanism 178 to swing the upper and lower griping pieces 140*a* and 140*b* to the first or second nip position N1 or N2, selectively, based on the detected results by the rotary encoder 352.

The feed motor 158 as a driving source of the take-in mechanism 18, the discharge mechanism 36 and the discharge shutter mechanism 64 is connected to the control unit 142.

Connected to the control unit 142 are the electromagnetic solenoid 130 constituting the clutch mechanism 128 of the second driving force transmitting mechanism 100 which is provided for transmitting the driving force of the alignment motor 72 to the longitudinal alignment mechanism 44, the electromagnetic solenoid 166 as the driving source of the take-in shutter mechanism 164, the electromagnetic solenoid 214 as the driving source of the gripper driving mechanism 176 and an electromagnetic solenoid 354 as a driving source for vertically moving the upper discharge belt 242.

Further the stapler mechanism 302 is connected to the control unit 142 and controlled thereby based on the detected result of the sensor 344. The discharge tray drive motor 310 is also connected to the control unit 142 and controlled thereby based on the detected result of the sensor 350 so that it is driven clockwise by a predetermined angle every detection (or ON operation) of the sensor 350.

[Description of operation of the sheet post treating apparatus 10]

Now, the description will be given about the operation of the sheet post-treating apparatus 10 the construction of which is described above in detail.

The sheet post-treating apparatus 10 is constructed so that it can execute the sorting treatment, the grouping treatment, the jogging treatment and the stapling treatment or a non-treatment mode.

In a condition where the non-treatment mode is set, all of the sorting trays 26 are moved to the respective lowest positions, that is, to a position where the sensor 328 is to be turned on. As a result, the copied sheets P discharged from the electrostatic copying machine 400 is taken-in to the uppermost sorting tray 26 which is located in the treatment position. Accordingly, the operator can easily take out all of the copied sheets P placed the uppermost sorting tray 26 therefrom.

With reference to FIGS. 10 through 19, the description will be given about each sheet post-treatment under the control of the control unit 142 in detail.

—Sort treatment—When the operator has selected the sorting mode through an operation panel which is not shown but provided to the electrostatic copying machine 400, the control unit 142 begins to execute the sorting treatment.

At first, where the size information relating to the copied sheet P to be transferred from the copying machine 400 is sent to the control unit 142 from a control device (not shown) of the copying machine 400, the electromagnetic solenoid 130 is energized to connect the clutch mechanism 128 and the alignment motor 72 is driven to rotate clockwise in FIG. 19.

In an initial stage of the sorting treatment, the cam follower 104 is engaged with the outer circumferential surface of the small diameter portion 102*a* of the cam member 102. Accordingly, the sector gear 106 is meshed with the first transmitting gear 82. As a result, the longitudinal aligning rod 46 is swung to the position corresponding to the size of the copied sheet P to be discharged from the copying machine 400 in a direction opposite to the take-in direction X upon the rotation of the alignment motor 72.

When the longitudinal aligning rod 46 has reached to the position corresponding to the size of the copied sheet P in the take-in direction X, the electromagnetic solenoid 130 is deenergized and thereby disconnecting the clutch mechanism 128. As a result, the planet gear 120 is separated from the third transmitting gear 116 and thereby cutting off the transmission of the driving force as well as the sun gear 118 is locked by the lock pawl 134. Accordingly, the longitudinal aligning rod 46 is held in the present position. The alignment motor 72 is then reversely driven to rotate counterclockwise and the lateral aligning rod 42 which has been moved in the discharge direction Y upon the clockwise rotation of the alignment motor 72 is returned to its home position.

In this condition, the copied sheet P transferred from the copying machine 400 is taken in onto the sorting tray 26A in the treatment position upon the rotation of the take-in rollers 22*a* which is driven to rotate by the feed motor 158. The copied sheet P which is taken in onto the sorting tray 26A in the treatment position is clamped between the longitudinal aligning rod 46 and the rear restriction plates 144 and thereby restricted in the take-in direction X (that is, the longitudinal position) to be aligned with each other all over the sorting trays 26.

After the copied sheet P is totally taken in onto the sorting tray 26A in the treatment position, the alignment motor 72 is driven to rotate clockwise again. Accordingly, the lateral aligning rod 42 is swung counterclockwise in the first opening 26*f* and thereby pushing the copied sheets P on each of the sorting trays 26 in the discharge direction Y to abut against the discharge shutter member 66. As a result, the copied sheet P on the sorting tray 26A in the treatment position is restricted in the discharge direction Y (that is, the lateral position) to be aligned with each other all over the sorting trays 26.

The alignment motor 72 is then reversely driven to rotate counterclockwise to return the lateral aligning rod 42 to its home position after the lateral aligning operation of the copied sheets P on the sorting trays 26 has been completed.

After the copied sheet P is completely placed on the sorting tray 26A in the treatment position, the tray drive motor 48 is drive to rotate each of the first through third screw rods 30, 32 and 34 by one revolution around the central vertical axis thereby moving the all of the sorting trays 26 upward by one pitch. That is to say, the next sorting tray 26 just below the uppermost sorting tray 26 is moved to the treatment position.

Just before the sorting trays 26 are raised, the electromagnetic solenoid 166 is energized whereby the take-in shutter plate 162 is moved to the close position as shown by the two-dots-and-dashed line in FIG. 9. Accordingly, the take-in shutter plate 162 is positioned between the sorting tray 26A in the treatment position and the take-in mechanism 18 whereby the exit of the take-in mechanism 18 is closed by the take-in shutter plate 162. As a result, the copied sheets P placed on the sorting tray 26A in the treatment position are prevented from unexpectedly touching to the outer peripheral surfaces of the rotating take-in rollers 22*a* thereby disturbing the present position of the copied sheets P and from being jammed between the lower and upper take-in rollers 22*a* and 22*b*.

In the sorting treatment, the tray drive motor 28 is driven to rotate the first through third screw rods 30, 32 and 34 by every revolution thereof to move the sorting trays 26 upward by one pitch whereby the copied sheets P with the same first page are successively taken in on the sorting trays 26. When a set of the copied sheets P with the first page are placed on the respective sorting trays 26, the copied sheets P with the second page are successively transferred from the copying machine 400. After the first copied sheet P with the second page is placed on the copied sheet P with the first page which has been already placed on the sorting tray 26A in the treatment position, the tray drive motor 48 is reversely driven to rotate thereby moving all of the sorting trays 26 downward.

When a series of the sorting treatment to plural sets of plural pages of the copied sheets P are completed, the electromagnetic solenoid 130 is deenergized to connect the clutch mechanism 128 and the alignment motor 72 is driven to rotate counterclockwise in FIG. 19. As a result, the longitudinal aligning rod 46 is moved in the take-in direction X in the second opening 26*g* to be returned to its home position upon the drive of the alignment motor 72. Accordingly, the operator can take out the copied sheets P on the sorting trays 26 with being not interfered by the longitudinal aligning rod 46.

—Grouping treatment—

When the operator has selected the grouping mode through the operation panel, the control unit 142 begins to execute the grouping treatment.

In the grouping treatment, the control unit 142 executes the substantially same process as the sorting treatment except that the tray drive motor 48 is not actuated while a set of the copied sheets P with the same page are transferred whereby the set of the copied sheets P with the same page are stacked on the sorting tray 26A in the treatment position. That is to say, in the grouping treatment, after all of the copied sheets P with the same page are finished to be stacked on the same sorting tray 26, the tray drive motor 48 is driven to move the next sorting tray 26 to the treatment position.

—Jogging treatment—

When the operator has selected the jogging mode through the operation panel, the control unit 142 begins to execute the jogging treatment.

In an initial stage of the jogging treatment, the tray drive motor 48 is driven to raise the all sorting trays 26 so as to move the lowest sorting tray 26 among the sorting trays 26 to which the copied sheets P are stacked to the treatment position. Also in the initial stage, the discharge shutter member 66 is located at the close position and the pair of gripping pieces 140*a* and 140*b* are in their home position, shown by the solid line in FIG. 11.

When a control signal relating to the start of the jogging treatment is sent to the control unit 142 from the control device of the copying machine 400, the feed motor 158 is driven to rotate, and driving force of the feed motor 158 is transmitted to the upper and lower roller driving shafts 252 and 248 of the discharge mechanism 36, thereby running the pair of discharge belts 242 and 244. The driving force of the upper roller driving shaft 252 is transmitted to the driving pulley 150 for moving the discharge shutter member 66, thereby moving the discharge shutter member 66 to the open position and opening the entrance of the discharge mechanism 36.

On the other hand, the alignment motor 72 is driven to rotate clockwise, the transmitting gear 172 of the gripper mechanism 178 to which the driving force of the alignment motor 72 is transmitted is rotated counterclockwise. Accordingly, the upper and lower gripping pieces 140*a* and 140*b* are swung clockwise about their respective proximal side supporting shafts 194 and 196 through the driven gear 202 with which the transmitting gear 172 is meshed, etc. The control unit 142 detects an amount of the rotation of the gripping pieces 140*a* and 140*b* based on the detected result from the rotary encoder 352 connected to the motor shaft of the alignment motor 72 and controls to stop the drive of the alignment motor 72 when it is detected that the gripping pieces 140*a* and 140*b* reach the first nip position N1.

Figure 13:
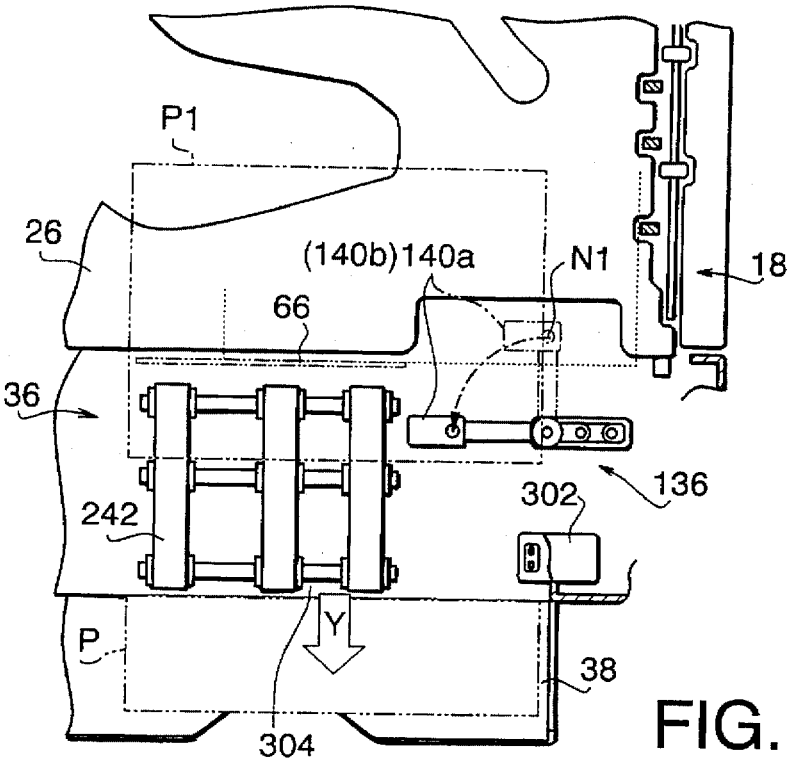
FIG. 13 is a plan view schematically showing the sheets pile discharge mechanism in a condition where the gripping pieces are returned to their home position and the pile of the copied sheets is taken out to the first discharge position.

Then, the electromagnetic solenoid 214 is energized to strongly grip the pile of the copied sheets P placed on the sorting tray 26A in the treatment position through the gripping pieces 140*a* and 140*b*. From this condition, the alignment motor 72 is reversely driven to rotate counterclockwise, thereby swinging the gripping pieces 140*a* and 140*b* by which the pile of the copied sheets P is gripped counterclockwise about their proximal side supporting shafts 194 and 196. When the home position sensor 338 is turned on, the drive of the alignment motor 72 is stopped and the electromagnetic solenoid 214 is deenergized. Accordingly, the pile of the copied sheets P is taken out from the sorting tray 26A in the treatment position to the first discharge position P1 in the discharge mechanism 36 without altering the posture of the pile, as shown in FIG. 13.

The pile of the copied sheets P transferred to the discharge mechanism 36 is fed in the discharge direction Y and discharged onto the discharge tray 38 upon the running of the upper and lower discharge belts 242 and 244.

When the discharge sensor 346 detects that the pile of the copied sheets P is discharged onto the discharge tray 38, the tray drive motor 48 is driven to rotate the first through third screw rods 30, 32 and 34 by one revolution, thereby moving the next sorting tray 26 to the treatment position. The take-out operation of the next pile of the copied sheets P by the take-out mechanism 136, is similar to the take-out operation of the first pile of the copied sheets P except that the upper and lower gripping pieces 140*a* and 140*b* are swung to the second nip position N2.

Figure 14:
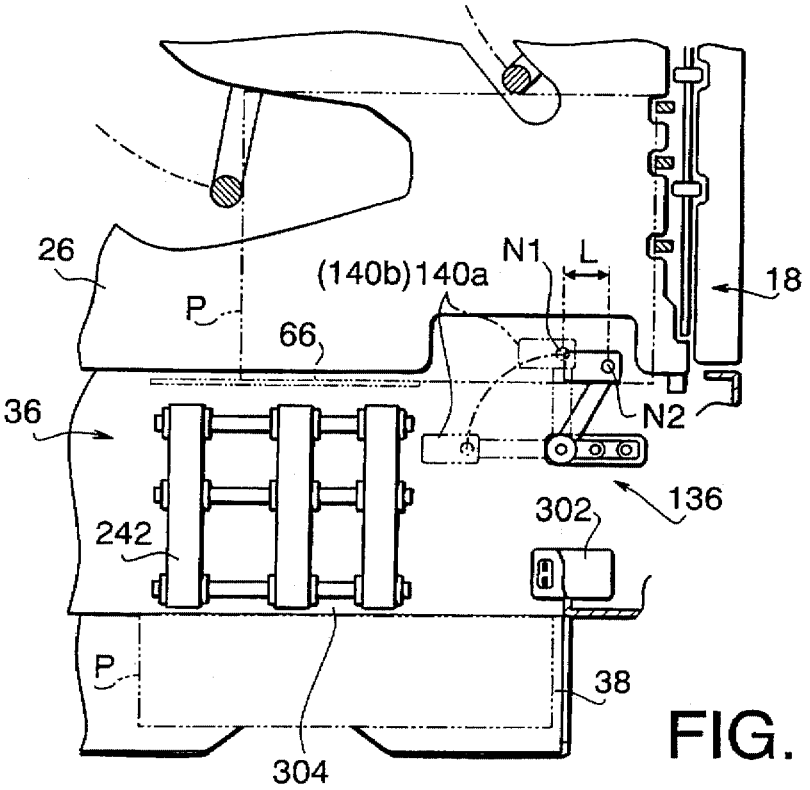
FIG. 14 is a plan view schematically showing the sheets pile discharge mechanism in a condition where the gripping pieces are moved to the second nip position.

More specifically, the control unit 142 controls to stop the drive of the alignment motor 72 when it detects that the gripping pieces 140*a* and 140*b* reach the second nip position N2 as shown in FIG. 14, based on the detected results from the rotary encoder 352. Then the same gripping operation of the gripping mechanism 172 to the pile of the copied sheets P placed on the next sorting tray 26A in the treatment position is executed. The pile of the copied sheets P is taken out from the next sorting tray 26A in the treatment position by the take-out mechanism 136 and the control unit 142 controls to stop the drive of the alignment motor 72 when it detects that the home position sensor 338 is turned on. Accordingly, the pile of the copied sheets P is transferred to the second discharge position P2 in the discharge mechanism 36.

Figure 15:
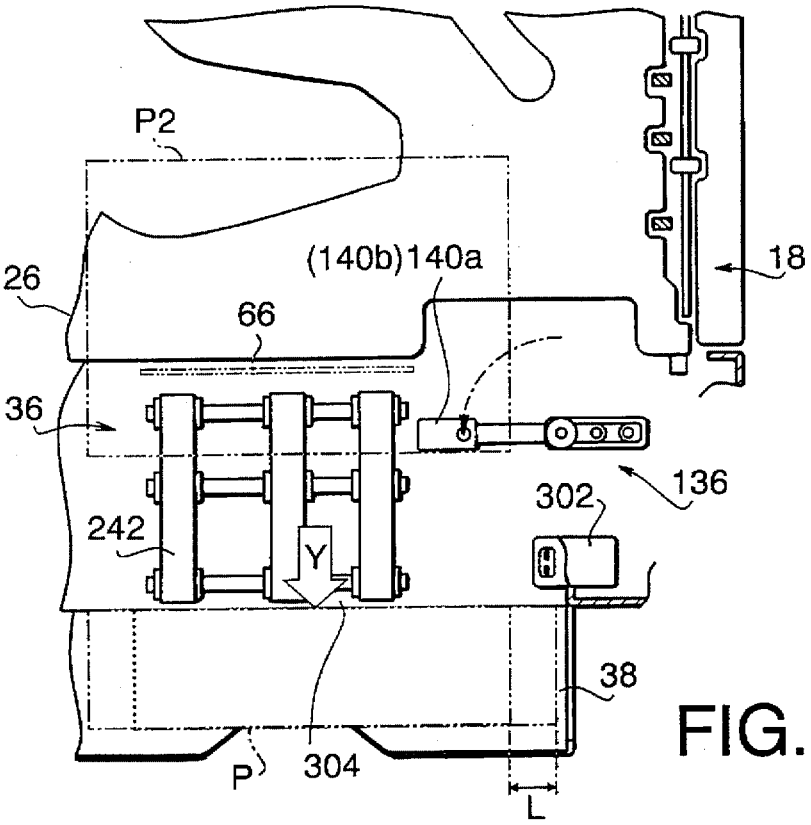
FIG. 15 is a plan view schematically showing the sheets pile discharge mechanism in a condition where the gripping pieces are returned to their home position and the pile of the copied sheets is taken out to the second discharge position.

As a result, the pile of the copied sheets P transferred to the discharge mechanism 36 is located in the second discharge position P2 which is displaced from the first discharge position P1 by the distance L in the take-in direction X, as shown in FIG. 15.

As mentioned above, the nip position by the gripper mechanism 174 is alternately changed between the first nip position N1 and the second nip position N2 every each sorting trays 26.

Namely, in the jogging treatment, the first nip position N1 is selected when the pile of the copied sheets P to be taken-out by the take-out mechanism 136 is placed on the sorting tray 26 the number of which is odd, while the second nip position N2 is selected when the pile of the copied sheets P to be taken-out by the take-out mechanism 136 is placed on the sorting tray 26 the number of which is even.

Accordingly, the piles of the copied sheets P are discharged to and placed on the discharge tray 38 alternately in the different two discharge positions P1 and P2. The two discharge positions P1 and P2 being displaced in the take-in direction X. Accordingly, the operator can pick up the whole piles from the discharge tray 38 while the operator can discriminate between sets when the sorting treatment has been executed and between pages when the grouping treatment has been executed and can easily count the number of the piles.

Note that the jogging treatment is further executed after the sorting treatment or the grouping treatment.

—Stapling treatment—

When the operator has selected the stapling mode through the operation panel, the control unit 142 begins to execute the stapling treatment. The stapling treatment is further executed after the sorting treatment or the grouping treatment but is alternatively executed to the jogging treatment.

In the jogging treatment, it is selectively set between a so-called "single staple mode" in which the pile of the copied sheets P is bound by only one staple S, and a so-called "double staples mode" in which the pile of the copied sheets P is bound by two staples S and S.

When the stapling treatment is set even though either of the single staple mode or double staples mode is selected, the first nip position N1 is only used in the take-out operation and accordingly, the first discharge position P1 is only used in the discharge operation in the stapling treatment.

In the single staple mode of the stapling treatment is selected, the pile of the copied sheets P placed on the sorting tray 26A in the treatment position is gripped by the upper and lower gripping pieces 140*a* and 140*b* in the first nip position N1 and taken out from the sorting tray 26A to the first discharge position P1 in the discharge mechanism 36. Then, the feed motor 156 is driven to rotate in the normal direction whereby the pile of the copied sheets P transferred in the first discharge position P1 is fed in the discharge direction Y.

After the detecting sensor 344 is turned on by the pile of the copied sheets P which is on the way to the discharge tray 38, the pile of the copied sheets P is further fed in the discharge direction Y by a predetermined distance which is corresponding to the sheet size and sheet posture. When a predetermined stapled position of the pile of the copied sheets P on an upstream side thereof with respect to the discharge direction Y is faced to the stapler mechanism 302 after the feed of the predetermined distance, the drive of the feed motor 156 is stopped and the stapler mechanism 302 is actuated to hit one staple S, thereby binding the pile of the copied sheets P by the single staple S.

Figure 16:
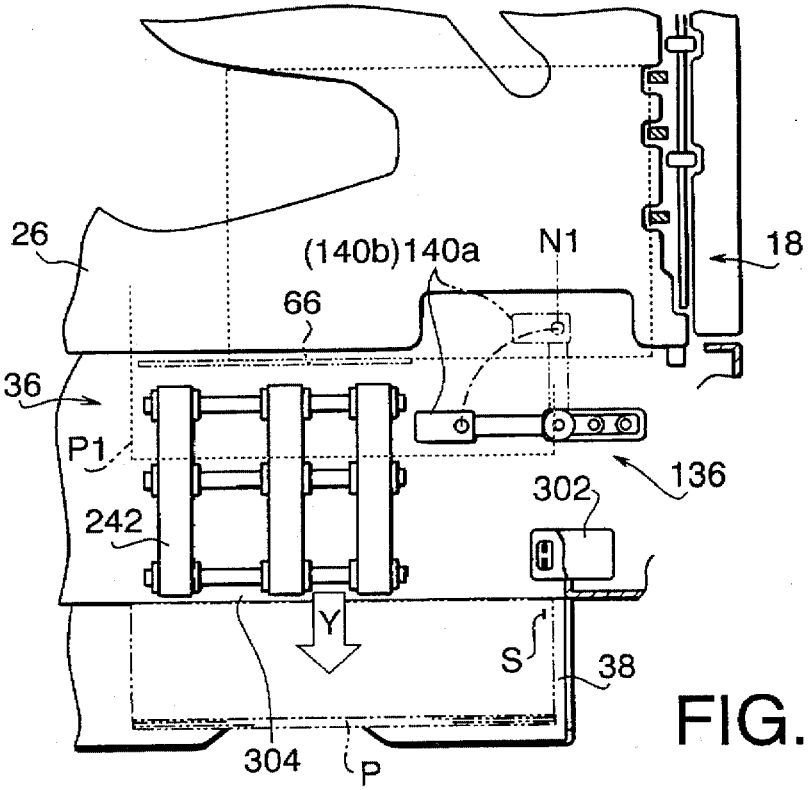
FIG. 16 is a plan view schematically showing the sheets pile discharge mechanism and the staple mechanism in a condition where the single staple mode of the stapling treatment is executed.

After the stapling operation of the stapler mechanism 302, the feed motor 156 is again driven to feed the pile of the copied sheets P in the discharge direction Y and therefore the pile which is bound by the single staple S is discharged onto the discharge tray 38, as shown in FIG. 16.

On the other hand, in the double staples mode of the stapling treatment is selected, the pile of the copied sheets P placed on the sorting tray 26A in the treatment position is gripped by the upper and lower gripping pieces 140*a* and 140*b* in the first nip position N1 and taken out from the sorting tray 26A to the first discharge position P1 in the discharge mechanism 36. Then, the feed motor 156 is driven to rotate in the normal direction whereby the pile of the copied sheets P transferred in the first discharge position P1 is fed in the discharge direction Y.

Figure 17:
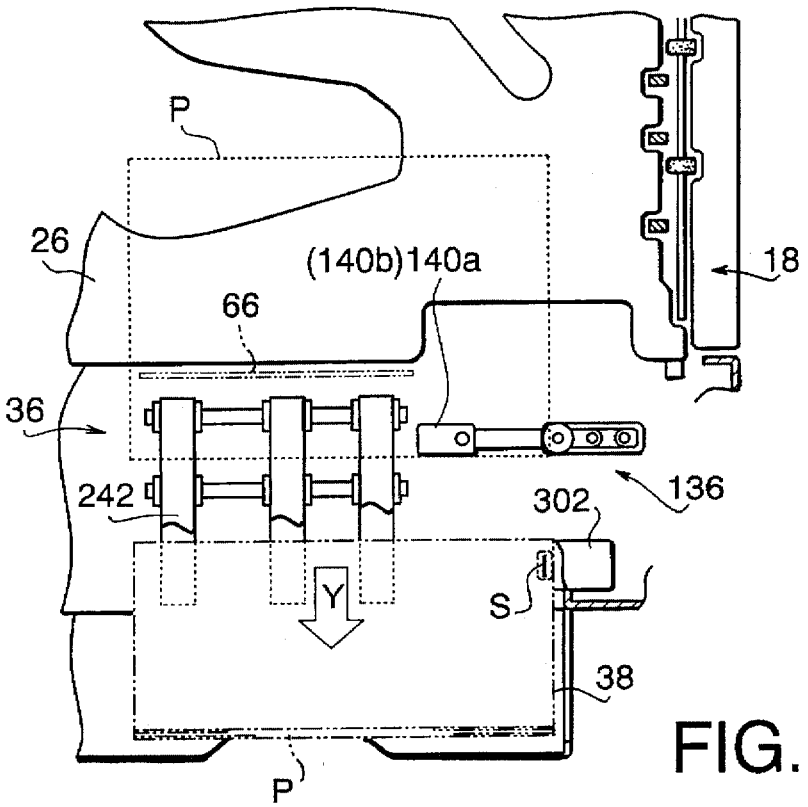
FIG. 17 is a plan view schematically showing the sheets pile discharge mechanism and the staple mechanism in a condition where the pile is bound by the first staple in the double staples mode of the stapling treatment.

After the detecting sensor 344 is turned on by the pile of the copied sheets P which is on the way to the discharge tray 38, the pile of the copied sheets P is further fed in the discharge direction Y by a first predetermined distance which is corresponding to the sheet size and sheet posture. When a first predetermined stapled position of the pile of the copied sheets P on an upstream side thereof with respect to the discharge direction Y is faced to the stapler mechanism 302, after the feed of the first predetermined distance, as shown in FIG. 17, the drive of the feed motor 156 is stopped and the stapler mechanism 302 is actuated to hit a first staple S, thereby binding the pile of the copied sheets P by the first staple S.

In a condition where the first staple S is hit to the pile of the copied sheets P, the distal end (or, an end on the downstream side of the pile with respect to the discharge direction Y) extends from the discharge port 304 over the discharge tray 38 which is attached to the frame 16 in the slant condition and falls down above the slant discharge tray 38. Since the proximal end 38*a* of the discharge tray 38 is lowered from the discharge port 304, however, the distal end of the pile of the copied sheets P is naturally bent and never touches the upper surface of the discharge tray 38. As a result, the stacking condition of the pile of the copied sheets P is prevented from collapsing and the stacking condition thereof is stably held.

The slant construction of the discharge tray 38 as shown in FIG. 4 is advantageous to shorten the length of the discharge mechanism 36 in the discharge direction Y. More specifically, since the distal end of the pile of the copied sheets P which protrudes from the discharge port 304 never touches to the discharge tray 38, the pile of the copied sheets P is surely clamped between the upper and lower gripping pieces 140*a* and 140*b* while the stacking condition is stably maintained. Accordingly, it is not necessary to set the length of the discharge mechanism 36 equal to or longer than that of the pile of the copied sheets P in the discharge direction Y. As a result, the length of the discharge mechanism 36 in the discharge direction Y can be shortened relative to the length of the pile of the copied sheets P in the discharge direction Y, thereby rendering the size of the sheet post-treating apparatus 10 to be more compact.

Figure 18:
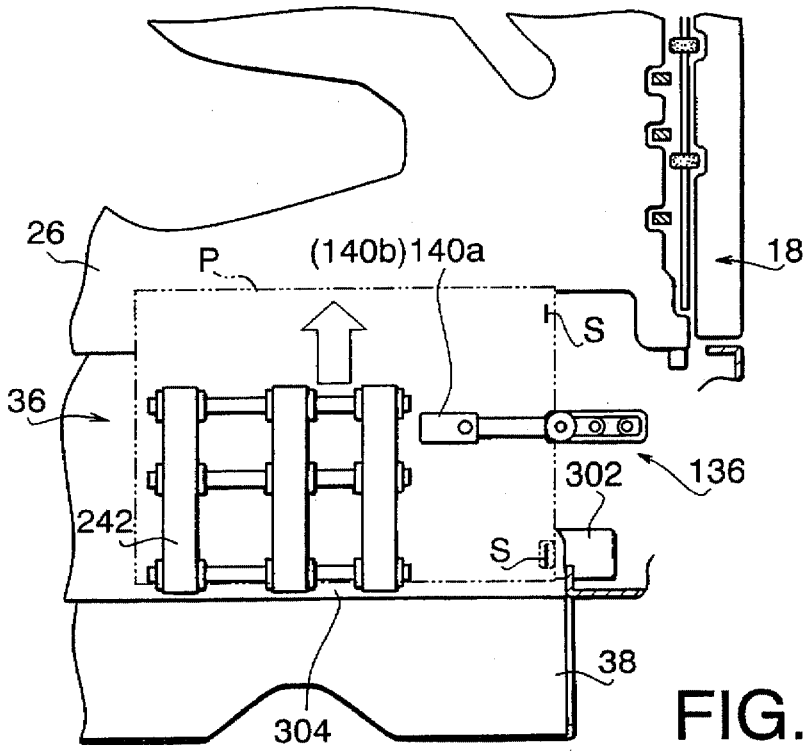
FIG. 18 is a plan view schematically showing the sheets pile discharge mechanism and the staple mechanism in a condition where the pile is further bound by the second staple in the double staples mode of the stapling treatment.

After the first stapling operation of the stapler mechanism 302, the feed motor 156 is reversely driven to return the pile of the copied sheets P by a second predetermined distance which corresponds to the sheet size and sheet posture in the direction opposite to the discharge direction Y when a first stapling operation completion signal is output from the stapling mechanism 302. When a second predetermined stapled position of the pile of the copied sheets P on a downstream side thereof with respect to the discharge direction Y is faced to the stapler mechanism 302 after the feed of the second predetermined distance, the drive of the feed motor 156 is stopped and the stapler mechanism 302 is actuated again to hit a second staple S, thereby binding the pile of the copied sheets P by the second staple S, as shown in FIG. 18.

After the second stapling operation of the stapler mechanism 302, the feed motor 156 is again driven to feed the pile of the copied sheets P in the discharge direction Y when a second stapling operation completion signal is output from the stapling mechanism 302 and therefore the pile which is bound by two staples S and S is discharged onto the discharge tray 38.

By repeating the temporary stop and reverse drive of the discharge mechanism 36, it would be able to bind the pile of the copied sheets P by a plurality of staples S.

It should be noted that, if the pile is firstly bound by the first staple S on the downstream side thereof with respect to the discharge direction Y (that is, on the distal or front end thereof in the discharge direction Y), and fed in the discharge direction Y to be bound by the second staple S as in the conventional art, the distal end of the pile is bent curvedly. Accordingly, if the pile is further bound by the second staple S on the upstream side thereof with respect to the discharge direction Y (that is, on the proximal or rear end thereof in the discharge direction Y) in the condition where the distal end of the pile is protruded from the discharge port 304 and bent curvedly, the pile which is bound by two staples S and S is formed to be bent curvedly and troublesomely maintained its bent shape even though it is placed on the flat plane.

However, in the present embodiment, since the pile is bound by the first staple S on the rear side at first, returned in the direction opposite to the discharge direction Y and then bound by the second staple S on the front side, the pile which is bound by two staples S and S is preferably set to be flat even though it is placed on the flat plane.

Having described a specific embodiment of the sheet post-treating apparatus, the present invention is not limited to the embodiment and it is believed obvious that modification and variation of the present invention is possible in light of the spirit and scope of the present invention.

In the above embodiment, for example, the electrostatic copying machine 400 is used as an image forming apparatus to which the sheet post-treating apparatus according to the present invention would be applied. The present invention is not limited to be applied to the electrostatic copying machine 400 as the image forming apparatus but applicable to a printer or any other sheet processor.

In the above preferred embodiment, the discharge tray 38 is set to be capable of swinging about the support shaft 306 in the vertical plane. However, the present invention is not limited to such a construction of the preferred embodiment and it is possible to vertically move the discharge tray 38 in the vertical direction.

Hereinafter, the description will be given about the discharge tray drive mechanism 358 according to the other embodiment of the present invention with reference to FIG. 23.

Figure 23:
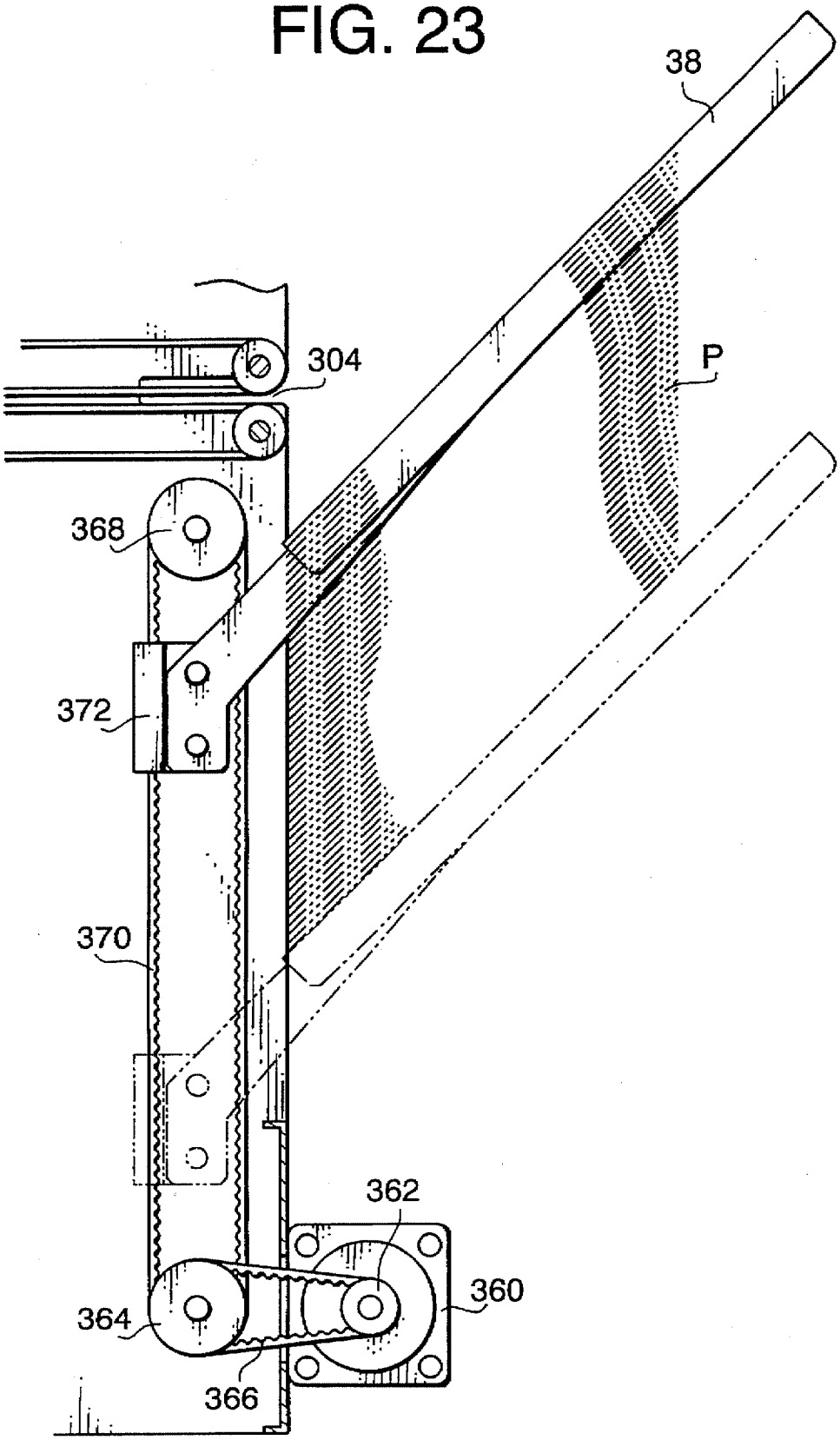
FIG. 23 is a side view showing a discharge tray and a drive mechanism for swinging the discharge tray according to the other embodiment of the present invention.

As shown in FIG. 23, the discharge tray 38 in the other embodiment is supported so as to be movable in the vertical direction through a guide mechanism (not shown). The discharge tray drive mechanism 358 generally includes a drive motor 360 as a driving source, a driving pulley 362 coaxially fixed to a motor shaft of the drive motor 360, a driven pulley 364 arranged beside the drive motor 360, a first endless belt 366 wound between the driven pulley 364 and driving pulley 362, an idle pulley 368 positioned higher than the uppermost position of the proximal end of the discharge tray 38, a second endless belt 380 wound between the driven pulley 364 and the idle pulley 368, and a coupling member 372 for coupling the discharge tray 38 to the second endless belt 372.

Since the discharge tray drive mechanism 358 is constructed as mentioned above, the discharge tray 38 is reciprocatively moved between an uppermost position (home position) shown by a solid line and a lowermost position shown by a two-dots-and-dashed line. The uppermost position of the discharge tray 38 is defined in such a manner that there is no copied sheets P discharged thereto. The drive motor 360 is connected to the control unit 142 and controlled thereby so that a distance (or height) between the discharge port 302 and the upper surface of the pile of the copied sheets P placed on the discharge tray 38 is substantially maintained to a predetermined constant value.

Accordingly, a multiple of the copied sheets P are capable of being discharged and placed on the discharge tray 38 in the present embodiment, the same as in the preferred embodiment.

As the present invention may be embodied in several forms without departing from the spirit of essential characteristics thereof, the present embodiment is therefore illustrative and not restrictive, since the scope of the present invention is defined by the appended claims rather than by the description preceding them, and all changes that fall within meets and bounds of the claims, or equivalence of such meets and bounds are therefore intended to embraced by the claims.

What is claimed is:

1. A sheet post-treating apparatus, comprising:

a frame;

a plurality of sorting trays to which sheets are successively supplied from an image forming apparatus and on which said sheets are collected and stacked, each of said sorting trays being movable in a vertical direction and one of said sorting trays which is moved to a treatment position where the sheets are to be discharged therefrom being set to be substantially horizontal;

discharge means for collectively discharging a pile of the sheets stacked on the horizontal sorting tray in a discharge direction which intersects to a supply direction in which the sheets are supplied from the image forming apparatus onto the sorting tray; and a discharge tray to which the pile of the sheets are discharged by the discharge means.

2. The apparatus according to claim 1, which further comprises:

tray drive means for moving the sorting trays in such a manner that all of the sorting trays are collectively moved upward or downward and one of the sorting trays is moved to the treatment position in order.

3. The apparatus according to claim 1, wherein each of said sorting trays is set to be substantially horizontal.

4. The apparatus according to claim 1, wherein said discharge direction is set to be perpendicular to said supply direction.

5. The apparatus according to claim 2, wherein said discharge tray is connected to the front side of said frame.

6. The apparatus according to claim 1, wherein said discharge tray is inclined to the discharge direction and parallel to the supply direction.

7. The apparatus according to claim 6, wherein said discharge means includes a horizontal discharge path which is substantially aligned with said sorting tray in the treatment position.

8. The apparatus according to claim 7, wherein said discharge tray has a proximal end which is lowered from the exit of the discharge path and a distal end which is higher than the proximal end thereof.

9. The apparatus according to claim 8, wherein said distal end of the discharge tray is set to be higher than an inlet port through which the sheet is taken in said frame from said image forming apparatus.

10. The apparatus according to claim 9, wherein said sheets from the image forming apparatus are directly introduced onto the sorting tray through said inlet port.

11. A sheet post-treating apparatus, comprising:

a frame;

a plurality of sorting trays to which sheets are successively supplied from an image forming apparatus and on which said sheets are collected and stacked, each of said sorting trays being movable in a vertical direction and one of said sorting trays which is moved to a treatment position where the sheets are to be discharged therefrom being set to be substantially horizontal;

discharge means for collectively discharging a pile of the sheets stacked on the horizontal sorting tray in a discharge direction; and a discharge tray to which the pile of the sheets are discharged by the discharge means and which is at least partially vertically movable, wherein said discharge direction intersects to a supply direction in which the sheets are supplied from the image forming apparatus onto the sorting tray.

12. The apparatus according to claim 11, wherein said discharge tray is capable of swinging about an end proximal to said frame.

13. The apparatus according to claim 12, wherein said proximal end of the discharge tray is displaced inside said frame.

14. The apparatus according to claim 13, which further comprises:

discharge tray drive means for swinging the discharge tray;

detect means for detecting the upper surface of the pile of the sheets stacked on said discharge tray; and control means for controlling said drive means in such a manner that said drive means swing said discharge tray so that a cross point between said discharge tray and a surface to which said discharge tray is arranged is gradually lowered based on a detected result of said detect means.

15. The apparatus according to claim 14, wherein said control means controls the drive means so as to maintain a distance between an exit of said discharge means and said cross point.

16. The apparatus according to claim 11, wherein said discharge tray is totally movable in the vertical direction.

17. The apparatus according to claim 14, which further comprises:

discharge tray drive means for moving the entire discharge tray in the vertical direction;

detect means for detecting the upper surface of the pile of the sheets stacked on said discharge tray; and control means for controlling said drive means in such a manner that said drive means moves said discharge tray so that a cross point between said discharge tray and a surface to which said discharge tray is arranged is gradually lowered based on a detected result of said detect means.

18. The apparatus according to claim 17, wherein said control means controls the drive means so as to maintain a distance between an exit of said discharge means and said cross point.

19. In combination a sheet processor and a post treating apparatus, said sheet processor being adjacent said post treating apparatus in a sheet feed direction, said post treating apparatus having a discharge tray extending in a sheet discharge direction that intersects said sheet feed direction, said tray having an upstream end and a downstream end, and being inclined downwardly from said downstream end toward said upstream end and said sheet discharge direction being set to intersect said sheet feed direction in which the sheet is fed from the sheet processor to the post treating apparatus.

* * * * *